US008418662B2

(12) United States Patent
Kim et al.

(10) Patent No.: US 8,418,662 B2
(45) Date of Patent: Apr. 16, 2013

(54) APPARATUS FOR VISUALLY INSPECTING AND REMOVING FOREIGN SUBSTANCE FROM GAP OF HEAT TUBE BUNDLE IN UPPER PART OF TUBE SHEET OF SECOND SIDE OF STEAM GENERATOR

(75) Inventors: Gyung-Sub Kim, Suwon-si (KR); Sang-Hoon Choi, Yongin-si (KR); Dong-Il Kim, Yongin-si (KR)

(73) Assignee: Korea Plant Service & Engineering Co., Ltd., Seongnam-Si (KR)

( * ) Notice: Subject to any disclaimer, the term of this patent is extended or adjusted under 35 U.S.C. 154(b) by 1306 days.

(21) Appl. No.: 12/175,891

(22) Filed: Jul. 18, 2008

(65) Prior Publication Data

US 2010/0011522 A1 Jan. 21, 2010

(51) Int. Cl.
*F22B 37/48* (2006.01)
*B08B 7/00* (2006.01)

(52) U.S. Cl.
USPC ..... 122/379; 122/363; 122/390; 122/396; 122/405; 15/3; 901/1; 180/447

(58) Field of Classification Search ..... 122/383, 122/390, 396, 405; 901/1; 280/771; 180/447; 446/85, 93, 95, 431, 437, 468; 104/138.1, 104/138.2
See application file for complete search history.

(56) References Cited

U.S. PATENT DOCUMENTS

| | | | | |
|---|---|---|---|---|
| 4,848,278 | A * | 7/1989 | Theiss | 122/383 |
| H1115 | H * | 12/1992 | Nachbar | 165/11.1 |
| 5,286,154 | A * | 2/1994 | Jens et al. | 414/7 |
| 5,575,328 | A * | 11/1996 | Hyp | 165/11.2 |
| 5,782,209 | A * | 7/1998 | Vandenberg | 122/379 |
| 6,144,180 | A * | 11/2000 | Chen et al. | 318/587 |
| 6,688,938 | B1 * | 2/2004 | Lee | 446/129 |
| 6,820,575 | B2 * | 11/2004 | Ashton et al. | 122/379 |
| 7,047,808 | B2 * | 5/2006 | Malvern et al. | 73/514.12 |
| 7,086,353 | B2 * | 8/2006 | Hwang et al. | 122/380 |
| 7,967,870 | B2 * | 6/2011 | Ko | 235/487 |
| 2005/0171727 | A1 * | 8/2005 | Sakabe et al. | 702/151 |
| 2006/0162610 | A1 * | 7/2006 | Reboredo Losada et al. | 104/138.1 |
| 2006/0207525 | A1 * | 9/2006 | Hernandez | 122/396 |
| 2007/0251045 | A1 * | 11/2007 | Choi et al. | 15/302 |
| 2008/0053382 | A1 * | 3/2008 | Kim | 122/279 |
| 2010/0030378 | A1 * | 2/2010 | Choi et al. | 700/245 |
| 2010/0275697 | A1 * | 11/2010 | Wu et al. | 73/717 |
| 2011/0005847 | A1 * | 1/2011 | Andrus et al. | 180/9.1 |
| 2011/0057674 | A1 * | 3/2011 | Weissacher et al. | 324/750.16 |
| 2011/0169938 | A1 * | 7/2011 | Webster et al. | 348/82 |

* cited by examiner

*Primary Examiner* — Steven B McAllister
*Assistant Examiner* — Nathaniel Herzfeld
(74) *Attorney, Agent, or Firm* — Birch, Stewart, Kolasch & Birch, LLP

(57) ABSTRACT

An apparatus that visually inspects a state of sludge and foreign substances found between steam generator bundles positioned at an upper portion of a tube sheet of a steam generator of a nuclear power plant using a visual inspector mounted in a robot moving on an inner wall surface of the steam generator for removing the foreign substances.

32 Claims, 26 Drawing Sheets

APPARATUS FOR VISUALLY INSPECTING AND REMOVING FOREIGN SUBSTANCE FROM GAP OF HEAT TUBE BUNDLE IN UPPER PART OF TUBE SHEET OF SECOND SIDE OF STEAM GENERATOR

BACKGROUND OF THE INVENTION

1. Field of the Invention

The present invention relates to an apparatus that visually inspects a state of sludge and a foreign substance between steam generator bundles positioned at an upper part of a tube sheet of a second side of a steam generator of a nuclear power plant (Korean standard type) using a visual inspector mounted in a robot moving on an inner wall surface of the steam generator and that removes a foreign substance using a foreign substance remover when the foreign substance is found.

2. Description of the Related Art

Conventionally, by grasping a guide member through a handhole of a steam generator and inserting an industrial endoscope camera into a penetration hole formed in the guide member, a gap of a heat tube bundle provided in the tube sheet of the second side of the steam generator was inspected.

However, using this method, an extremely limited portion, i.e. only a gap of a heat tube bundle provided around a handhole and between handholes was inspected.

SUMMARY OF THE INVENTION

The present invention has been made in an effort to solve the above problems, and the present invention provides an apparatus for visually inspecting and removing a foreign substance from a gap of a heat tube bundle in an upper part of a tube sheet of a second side of a steam generator that manipulates a robot moving on an inner wall surface of the steam generator on the spot or at the outside, moves the robot on an inner wall surface of the steam generator by a predetermined distance, i.e. by a distance between gaps of the heat tube bundle using a visual inspector and a foreign substance remover provided in the robot, visually inspects sludge or a foreign substance generated between gaps of the heat tube bundle using the visual inspector and the foreign substance remover, and removes the sludge or the foreign substance.

According to an aspect of the present invention, there is provided an apparatus for visually inspecting and removing a foreign substance from a gap of a heat tube bundle in an upper part of a tube sheet of a second side of a steam generator, including: a robot including a transfer unit that moves on a wall surface within a ring of the steam generator, a lift that is provided in the transfer unit to vertically move upward and downward, a visual inspector that is rotatably provided in the lift, and that moves upward and downward by driving the lift, and that monitors sludge or a foreign substance injected into a gap of the heat tube, and a foreign substance remover that is provided at one side of the visual inspector and that removes sludge or a foreign substance existing in the gap of the heat tube; a controller that is provided at one side of the steam generator and that controls the robot on the spot; a remote controller that is provided at the outside, and that is connected to the controller through a wire, and that controls the robot; and an encoder mounting fixture that is fixed to one side of a handhole of the steam generator, and that is connected to the controller through a first cable, and that receives and supplies a second cable connected to the robot.

BRIEF DESCRIPTION OF THE DRAWINGS

The objects, features and advantages of the present invention will be more apparent from the following detailed description in conjunction with the accompanying drawings.

DESCRIPTION OF THE PREFERRED EMBODIMENT

An exemplary embodiment of an apparatus for visually inspecting and removing a foreign substance from a gap of a heat tube bundle in an upper part of a tube sheet of a second side of a steam generator according to the present invention will be described hereinafter in detail with reference to the accompanying drawings.

Figure 1:
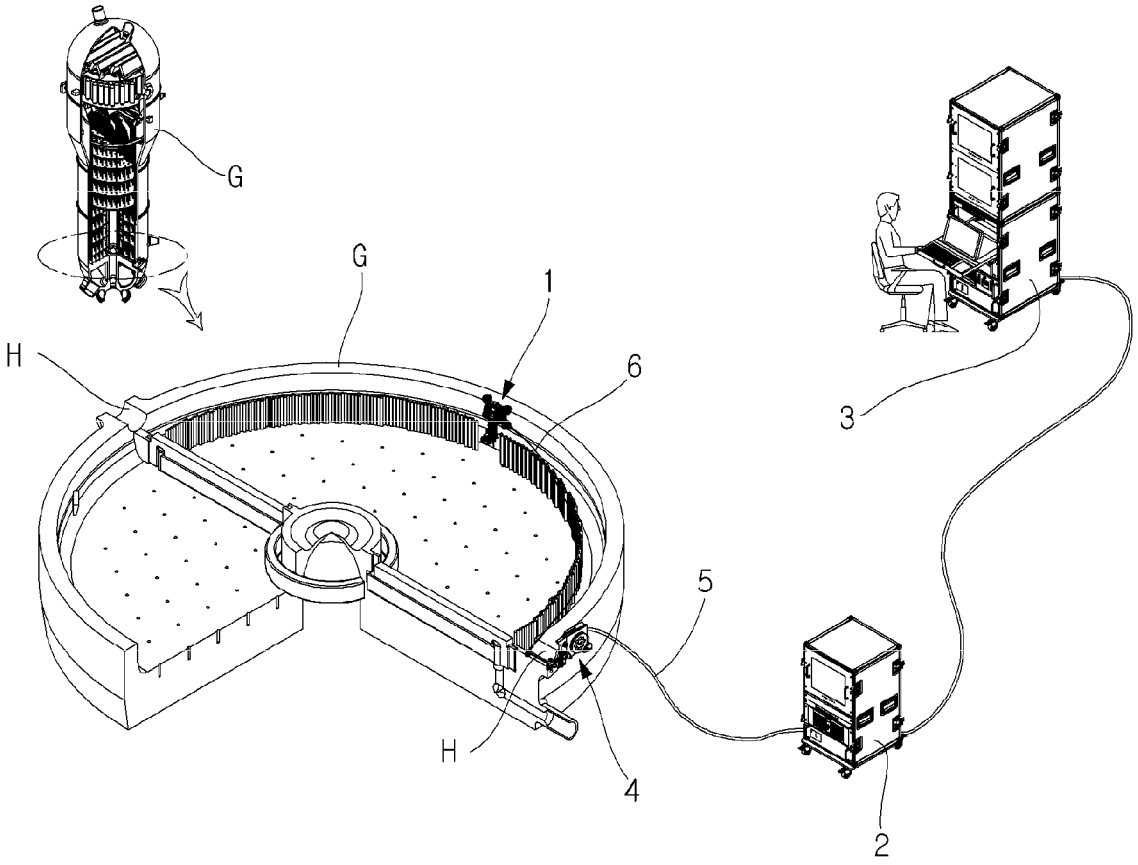
FIG. 1 is a view illustrating an apparatus for visually inspecting and removing a foreign substance from a gap of a heat tube bundle in an upper part of a tube sheet of a second side of a steam generator according to the present invention.

As shown in FIG. 1, the apparatus for visually inspecting and removing a foreign substance from a gap of a heat tube bundle in an upper part of a tube sheet of a second side of a steam generator includes a robot 1 that is provided in an inner wall through a handhole H of a steam generator G and that performs a function of transfer, visual inspection of sludge or a foreign substance, and removal of the foreign substance by a manipulation of an operator; a controller 2 that is provided in one side of the steam generator G and that controls the robot 1; a remote controller 3 that is provided in the outside and that is connected to the controller 2 through a wire to control the robot 1; and an encoder mounting fixture 4 that is fixed to one side of the handhole H, and that is connected to the controller 2 through a first cable 5, and that receives and supplies a second cable 6 connected to the robot 1.

Figure 2:
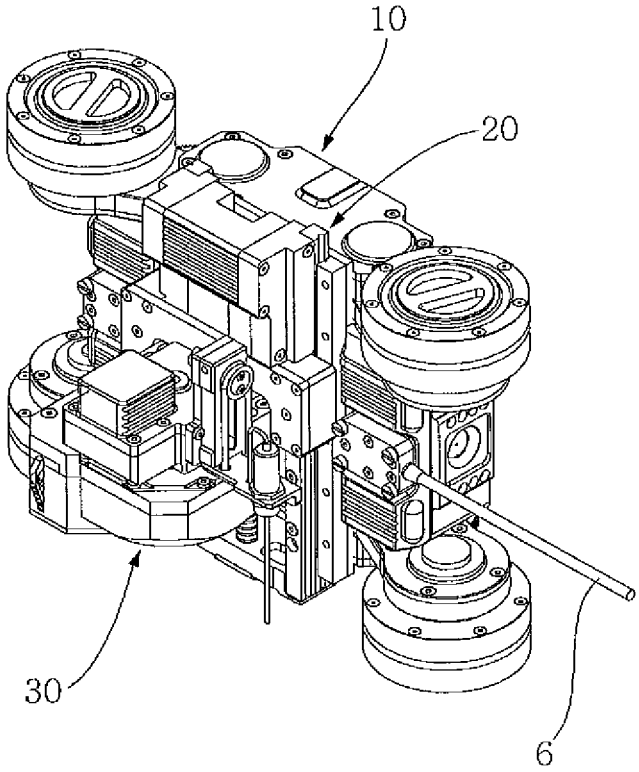
FIG. 2 is a view illustrating a robot of an apparatus for visually inspecting and removing a foreign substance from a gap of a heat tube bundle in an upper part of a tube sheet of a second side of a steam generator according to the present invention.

As shown in FIGS. 1 and 2, the robot 1 includes a transfer unit 10 that moves on a wall surface within a ring of the steam generator G; a lift 20 that is provided in the transfer unit 10 to vertically move upward or downward; a visual inspector 30 that is provided to rotate about a vertical shaft in the lift 20 and that moves upward or downward by driving of the lift 20, and that monitors sludge or a foreign substance injected into a gap of a heat tube bundle; and a foreign substance remover (not shown) that is provided at one side of the visual inspector 30 and that removes sludge or a foreign substance existing in the gap of the heat tube.

Figure 3:
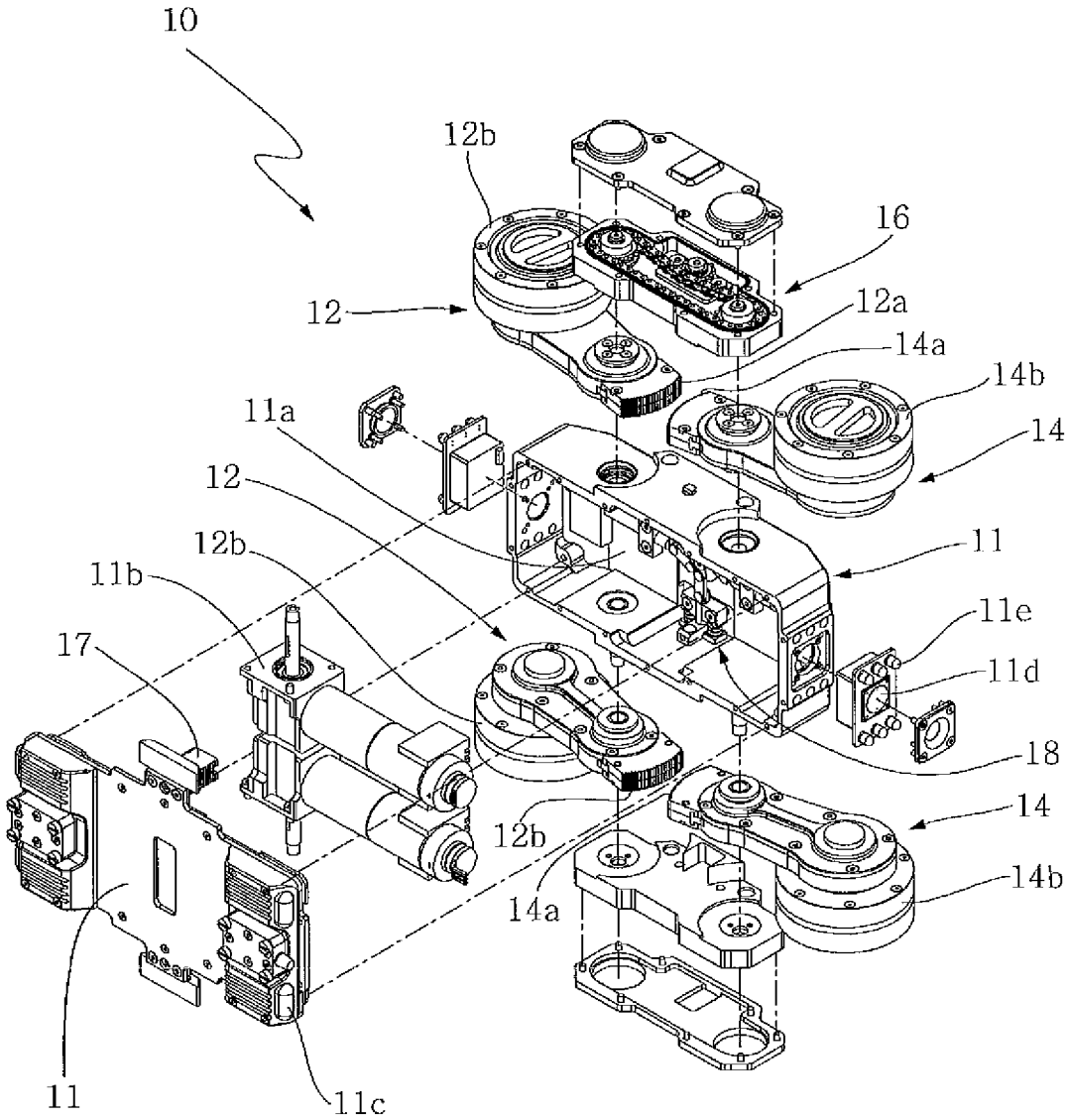
FIG. 3 is an exploded perspective view illustrating a transfer unit of an apparatus for visually inspecting and removing a foreign substance from a gap of a heat tube bundle in an upper part of a tube sheet of a second side of a steam generator according to the present invention.
Figure 4:
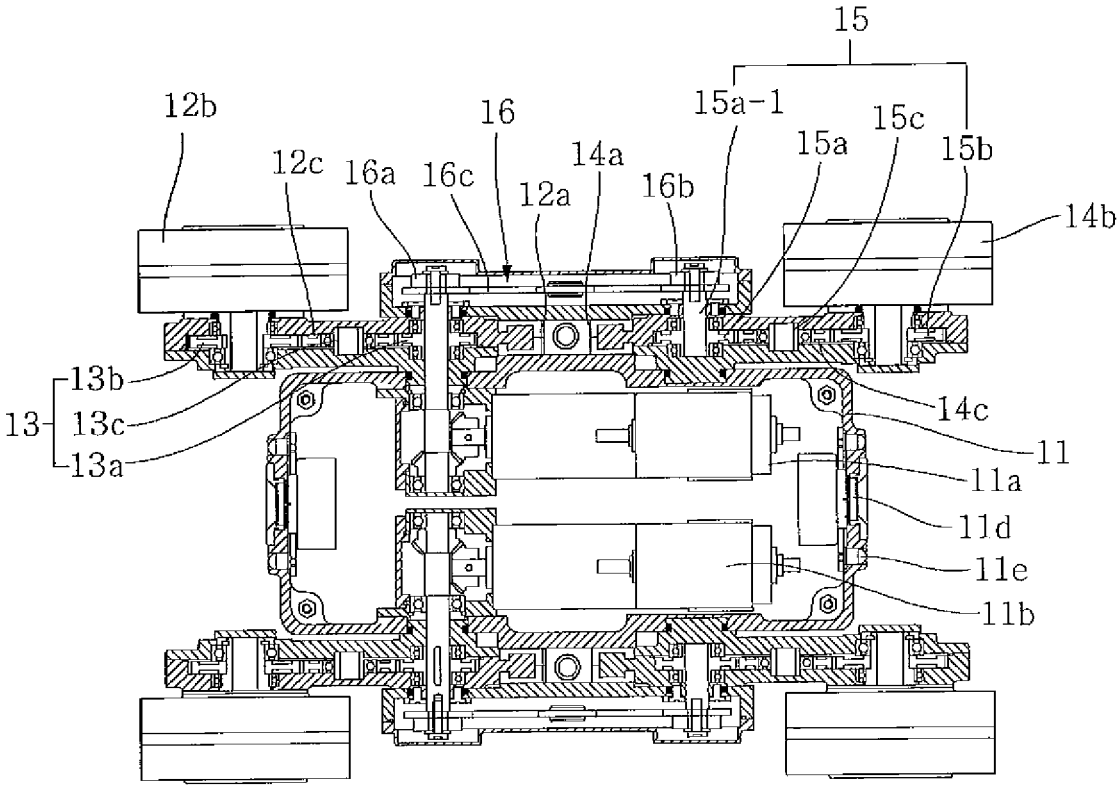
FIG. 4 is a cross-sectional view illustrating a coupled state of the transfer unit of FIG. 3.
Figure 5:
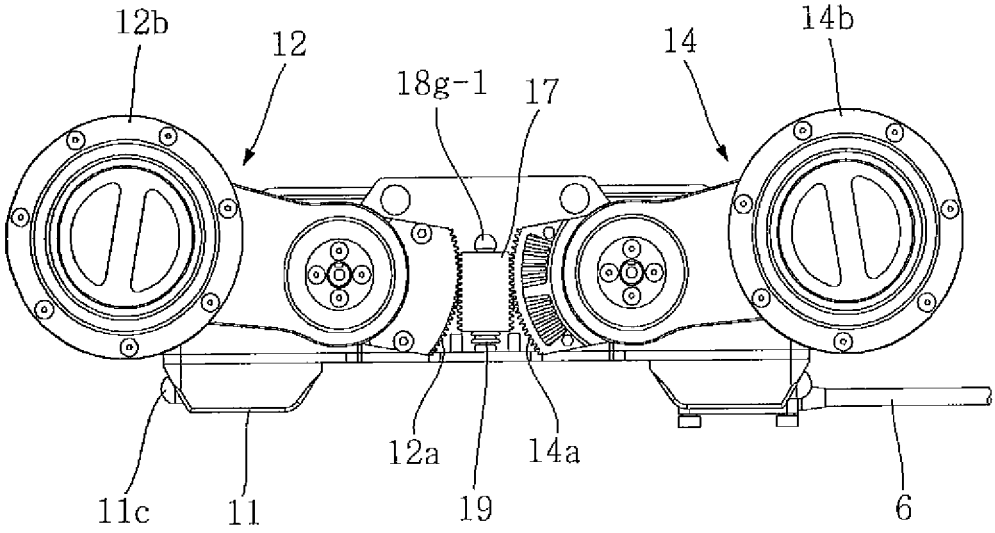
FIG. 5 is a top plan view illustrating a coupled state of the transfer unit of FIG. 3.

As shown in FIGS. 3 to 5, the transfer unit 10 includes a main body 11 that has a first reception unit 11*a* therein and that has a pair of first motors 11*b* in the first reception unit 11*a*; a front wheel arm 12 that is rotatably provided in both surfaces of one side of the main body 11 and that has a first thread 12*a* in one end surface thereof and that has a first magnetic wheel 12*b* in one surface of the other side thereof, and that has a second reception unit 12*c* therein; a first gear group 13 that is provided in the second reception unit 12*c* of the front wheel arm 12 and that drives the first magnetic wheel 12*b* provided in the front wheel arm 12 by transferring power of the first motor 11*b*; a rear wheel arm 14 that is symmetrical to the front wheel arm 12 and rotatably provided in both surfaces of the other side of the main body 11, and that has a second thread 14*a* in one end surface thereof, and that has a second magnetic wheel 14*b* in one surface of the other side thereof and that has a third reception unit 14*c* therein; a second gear group 15 that is provided in the third reception unit 14*c* of the rear wheel arm 14 and that drives the second magnetic wheel 14*b* provided in the rear wheel arm 14 by transferring power of the first motor 11*b*; a power transmission means 16 that transfers power of the first motor 11*b* to the second gear group 15; an equalizer 17 that is provided in the main body 11 to engage with the first thread 12*a* of the front wheel arm 12 and the second thread 14*a* of the rear wheel arm 14 and that is slidably provided when the first wheel arm 12 and the rear wheel arm 14 are rotated by the first magnetic wheel 12*b* and the second magnetic wheel 14*b* attached to an inner wall surface of the steam generator G when an operator pulls the main body 11; a fixing and release means 18 that is provided in the main body 11 and that fixes and releases the moved equalizer 17; and a first spring 19 that is provided between the main body 11 and the equalizer 17 and that returns the rotated front wheel arm 12 and rear wheel arm 14 to their original positions by pushing the equalizer 17 in which fixing is released by the fixing and release means 18.

Because the inside of the steam generator G is dark, it is preferable that at least one light 11*c* is provided in both surfaces of the main body 11. Further, when the transfer unit 10 moves, a first camera 11*d* is further provided in the both surfaces of the main body 11 so that the operator may monitor movement of the transfer unit 10, and when monitoring is performed using the first camera 11*d*, it is preferable that at least one first high luminance light-emitting diode 11*e* is provided at one side of the first camera 11*d*.

As shown in FIG. 4, the first gear group 13 includes a first gear 13*a* that is positioned at the second reception unit 12*c* of the front wheel arm 12 and that is provided in a drive shaft of the first motor 11*b*, a second gear 13*b* that is provided in a rotation shaft of the first magnetic wheel 12*b* of the front wheel arm 12, and a third gear 13*c* that is provided to engage with the first gear 13*a* and the second gear 13*b*, thereby transferring power of the first motor to the first magnetic wheel 12*b* to drive the first magnetic wheel 12*b*.

As shown in FIG. 4, the second gear group 15 includes a fourth gear 15*a* that is positioned at the third reception unit 14*c* of the rear wheel arm 14 and that has a shaft (15*a*-1), a fifth gear 15*b* that is provided in a rotation shaft of a second magnetic wheel 14*b* of the rear wheel arm 14, and a sixth gear 15*c* that is provided to engage with the fourth gear 15*a* and the fifth gear 15*b*, thereby transferring power of the first motor 11*b* to be transferred through a power transmission member 16 to be described later to the second magnetic wheel 14*b* to drive the second magnetic wheel 14*b*.

Figure 6:
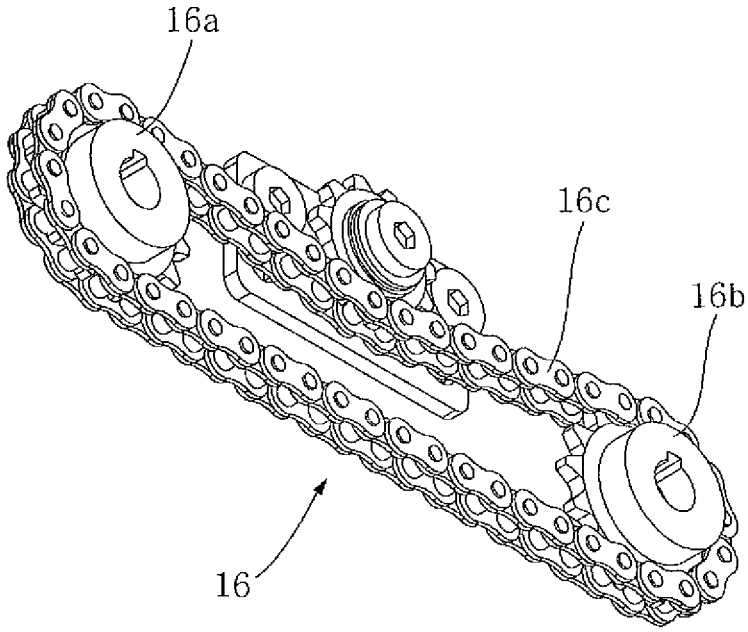
FIG. 6 is a view illustrating a power transmission means of an apparatus for visually inspecting and removing a foreign substance from a gap of a heat tube bundle of an upper part of a tube sheet of a second side of a steam generator according to the present invention.

As shown in FIG. 6, the power transmission means 16 includes a seventh gear 16*a* that is provided at an upper end of the drive shaft of the first motor 11*b*, an eighth gear 16*b* that is provided in the shaft (15*a*-1) of the fourth gear 15*a*, and a chain 16*c* that is provided in the seventh gear 16*a* and the eighth gear 16*b*, thereby transferring power of the first motor 11*b* to the second gear group 15.

Figure 7:
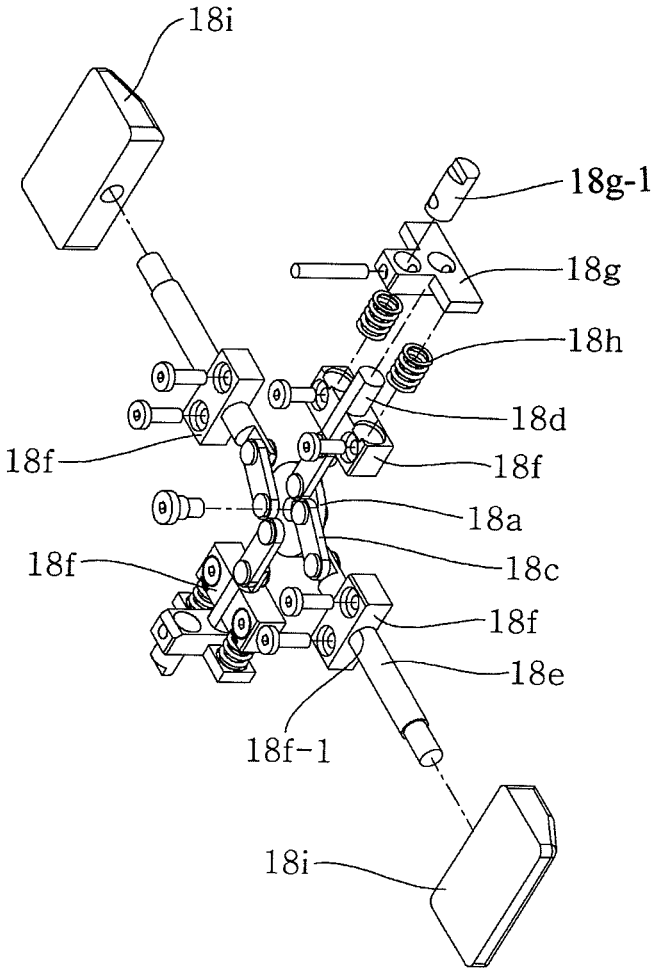
FIG. 7 is an exploded perspective view illustrating a fixing and release means of an apparatus for visually inspecting and removing a foreign substance from a gap of a heat tube bundle of an upper part of a tube sheet of a second side of a steam generator according to the present invention.
Figure 8:
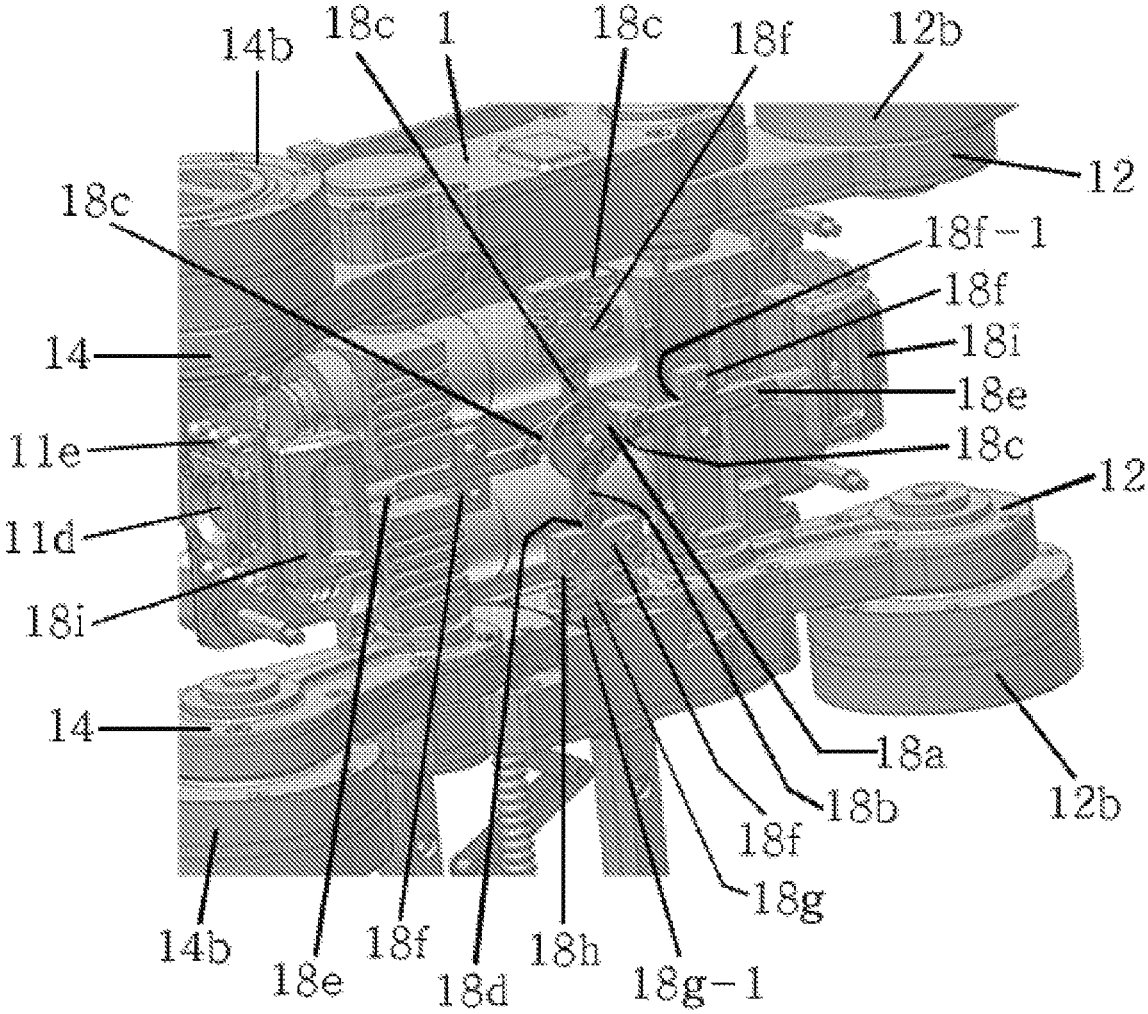
FIG. 8 is a view illustrating a state in which the fixing and release means of FIG. 7 is provided in the transfer unit.
Figure 9:
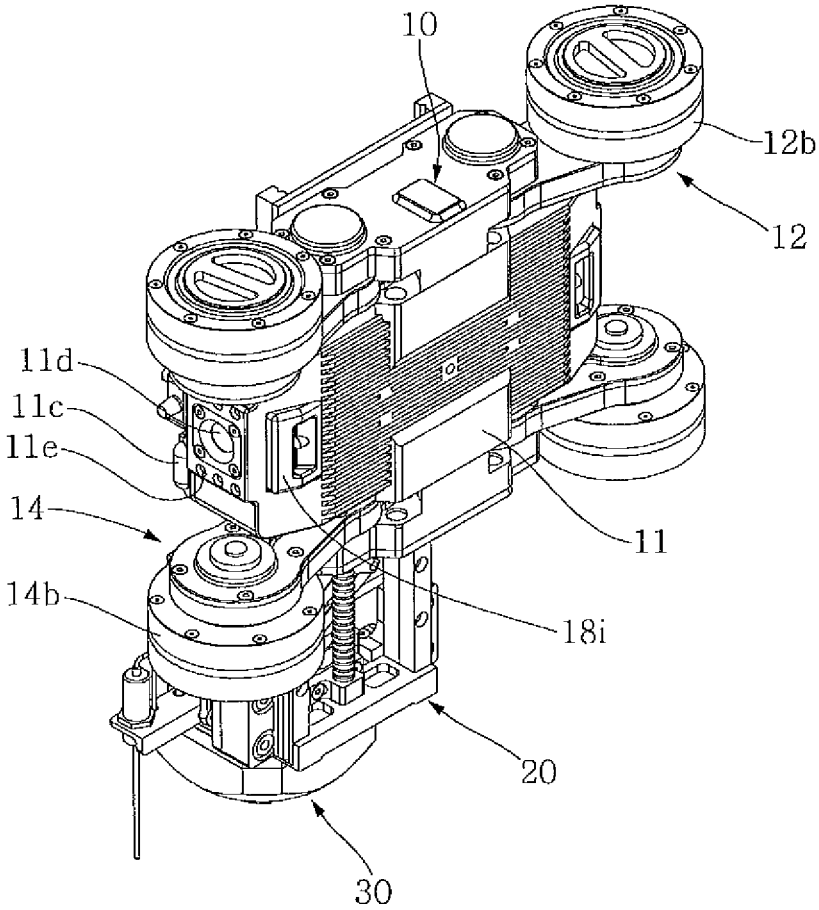
FIG. 9 is a view illustrating a state in which a fixing and release means of an apparatus for visually inspecting and removing a foreign substance from a gap of a heat tube bundle in an upper part of a tube sheet of a second side of a steam generator according to the present invention is provided in the transfer unit and only a handle thereof is protruded to the outside.

As shown in FIGS. 7 to 9, the fixing and release means 18 includes a disk 18*a* that is rotatably provided in one side of the first reception unit 11*a* of the main body 11, a pair of first rods 18*b* whose one end is rotatably provided in both sides of the disk 18*a*, a pair of second rods 18*c* that is provided in the disk 18*a* and whose one end is rotatably provided at a position forming an acute angle with the first rod 18*b*, a third rod 18*d* that is rotatably provided at the other end of the first rod 18*b*, a fourth rod 18*e* that is rotatably provided at the other end of the second rod 18*c*, a guide block 18*f* that is fixed to the first reception unit 11*a* of the main body 11 and that has a hole (18*f*-1) for receiving a part of the third rod 18*d* and the fourth rod 18*e*, a plate 18*g* that is fixed to a free end of the third rod 18*d* and in which a fastening pin (18*g*-1) for fixing the equalizer 17 is provided in one surface thereof to be exposed to the outside of the main body 11, and a second spring 18*h* that is provided between the guide block 18*f* and the plate 18*g* to sustainably push the plate 18*g* such that the fastening pin (18*g*-1) is exposed to the outside of the main body 11, and a handle 18*i* that is provided at a free end of the fourth rod 18*e* and that is provided to be exposed to the outside of the main body 11.

Here, the fastening pin (18*g*-1) is provided to contact with one surface of the equalizer 17, and if the equalizer 17 is moved by a rotation of the front wheel arm 12 and the rear wheel arm 14, the fastening pin (18*g*-1) is protruded to the outside of the main body 11 by the second spring 18*h* to fix the equalizer 17.

Figure 10:
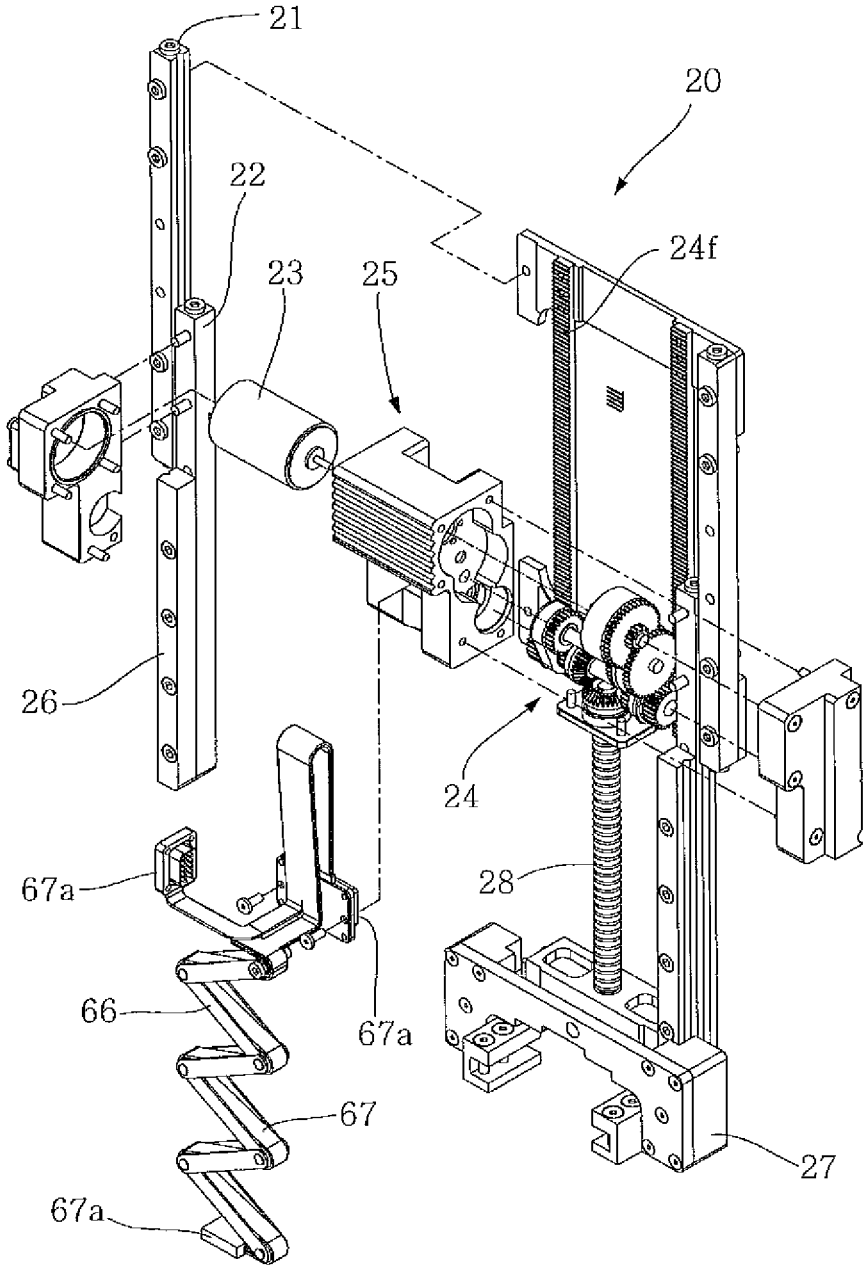
FIG. 10 is an exploded perspective view illustrating a lift of an apparatus for visually inspecting and removing a foreign substance from a gap of a heat tube bundle in an upper part of a tube sheet of a second side of a steam generator according to the present invention.

As shown in FIG. 10, the lift 20 includes a first guide rail 21 that is vertically provided in parallel to and apart a predetermined distance in the main body 11, a pair of slide bars 22 that is movably provided in the first guide rail 21, a gear box 25 that is provided in the slide bar 22 and that has a second motor 23 and a gear assembly 24 therein, a second guide rail 26 that is provided in one surface of the slide bar 22, a slide block 27 that is provided in the second guide rail 26, and a screw 28 whose thread is engaged with the slide block 27 and whose upper end is connected to the gear assembly 24 to move the slide block 27 when the gear assembly 24 is driven.

When the gear assembly 24 is driven, the gear box 25 moves upward or downward on the first guide rail 21, and at the same time, the screw 28 rotates and thus the slide block 27 whose thread is engaged with the screw 28 also moves upward or downward on the second guide rail 26.

Figure 11:
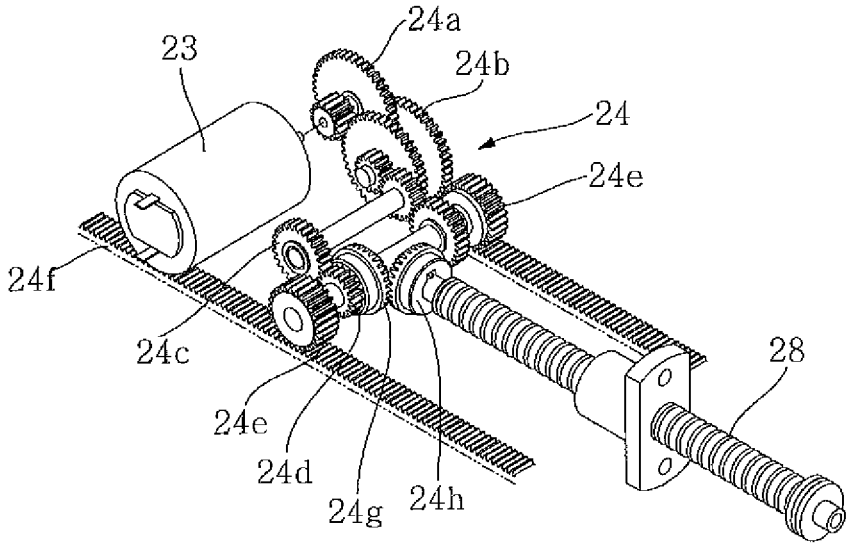
FIG. 11 is a view illustrating a gear assembly of FIG. 10.

As shown in FIG. 11, the gear assembly 24 includes a ninth gear 24*a* that is provided in a drive shaft of the second motor 23, a tenth gear 24*b* that is provided to engage with the ninth gear 24*a*, an eleventh gear 24*c* that is provided to engage with the tenth gear 24*b*, a twelfth gear 24*d* that is provided to engage with the eleventh gear 24*c*, a pinion gear 24*e* that is provided in both ends of a shaft rod of the twelfth gear 24*d*, a rack gear 24*f* that is provided in the main body 11 to be parallel to the first guide rail 21 and that engages with the pinion gear 24*e* to move upward or downward the gear box 25 when the pinion gear 24*e* is driven, a driving bevel gear 24*g* that is provided at one point of the shaft rod of the twelfth gear 24*d*, and a driven bevel gear 24*g* that is provided at an upper end of the screw 28 and that engages with the driving bevel gear 24*h* and that transfers power of the second motor 23 to the screw 28 to rotate the screw 28.

Figure 12:
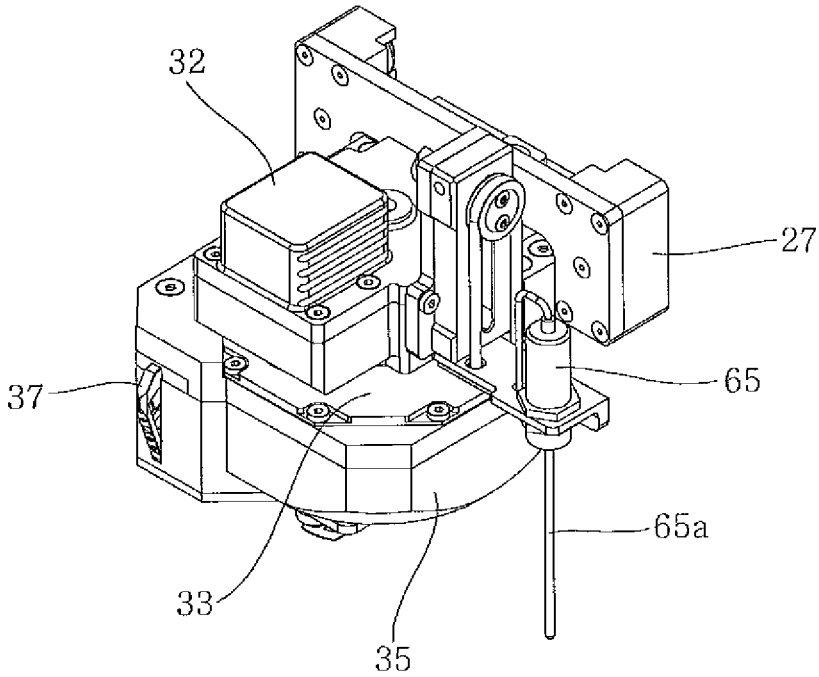
FIG. 12 is a view illustrating a visual inspector of an apparatus for visually inspecting and removing a foreign substance from a gap of a heat tube bundle in an upper part of a tube sheet of a second side of a steam generator according to the present invention.
Figure 13:
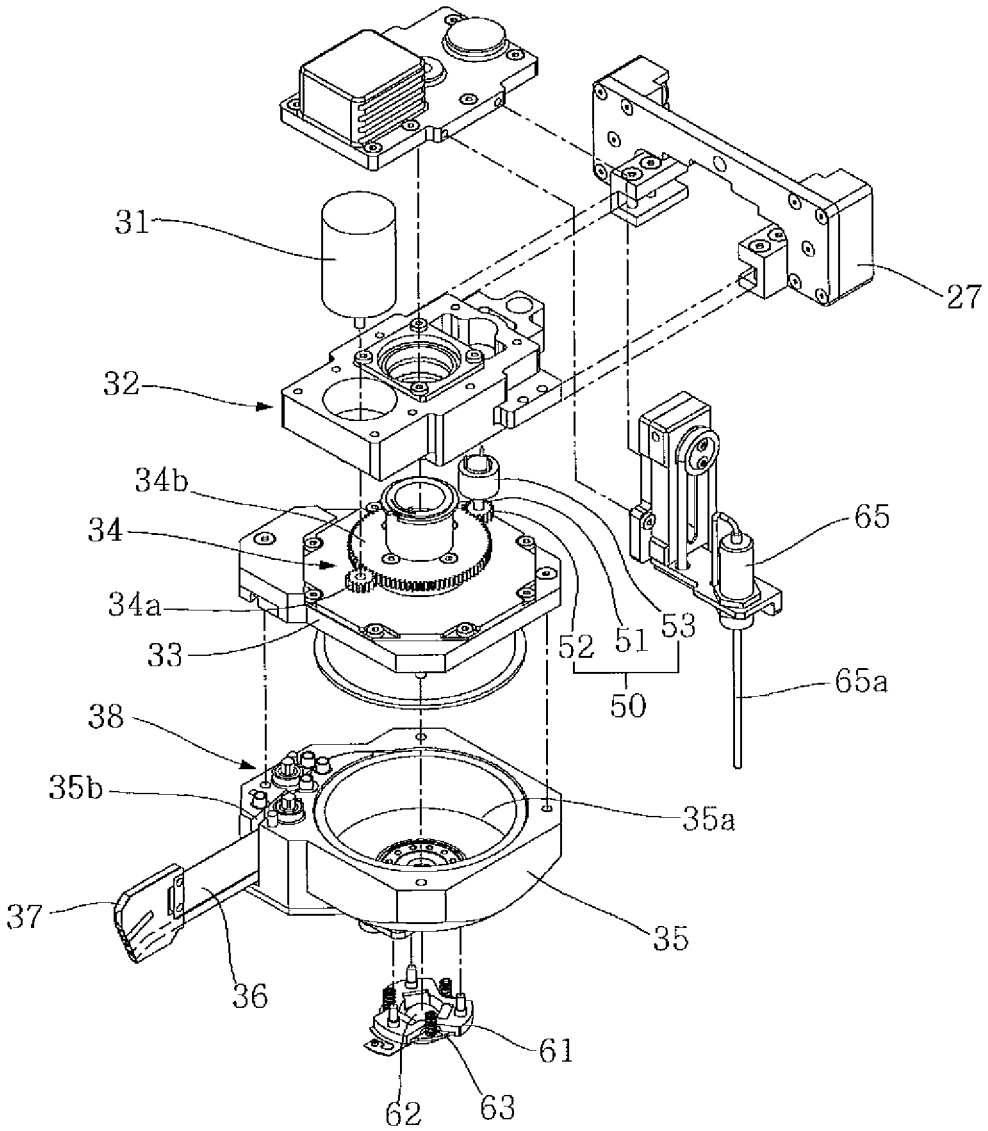
FIG. 13 is a perspective view illustrating an exploded state of the visual inspector of FIG. 12.

As shown in FIGS. 12 and 13, the visual inspector 30 includes a box 32 that is provided in a slide block 27 of the lift 20 and that has a third motor 31 therein, a rotation plate 33 that is rotatably provided in a lower part of the box 32, a rotation means 34 that rotates the rotation plate 33, a case 35 that is provided in a lower part of the rotation plate 33 and that has a housing space 35*a* therein and that has a groove 35*b* so that an external surface of one side thereof is communicated with the housing space 35*a*, a belt 36 whose one end is wound, whose winding portion is positioned at the housing space 35*a* of the case 35, and whose the other end is received into the groove 35*b*, a probe 37 that is provided in the other end of the belt 36 and that has a second camera 37*a* and a second light-emitting diode 37*b*, and a winding means 38 that unwinds or winds the belt 36.

As shown in FIG. 13, the rotation means 34 includes a thirteenth gear 34*a* that is provided in a drive shaft of the third motor 31, and a fourteenth gear 34*b* that engages with the thirteenth gear 34*a* and that is fixed to an upper surface of the rotation plate 33, and when the third motor 31 is driven, the rotation means 34 receives power to rotate the rotation plate 33 connected to the fourteenth gear 34*b*.

Figure 14:
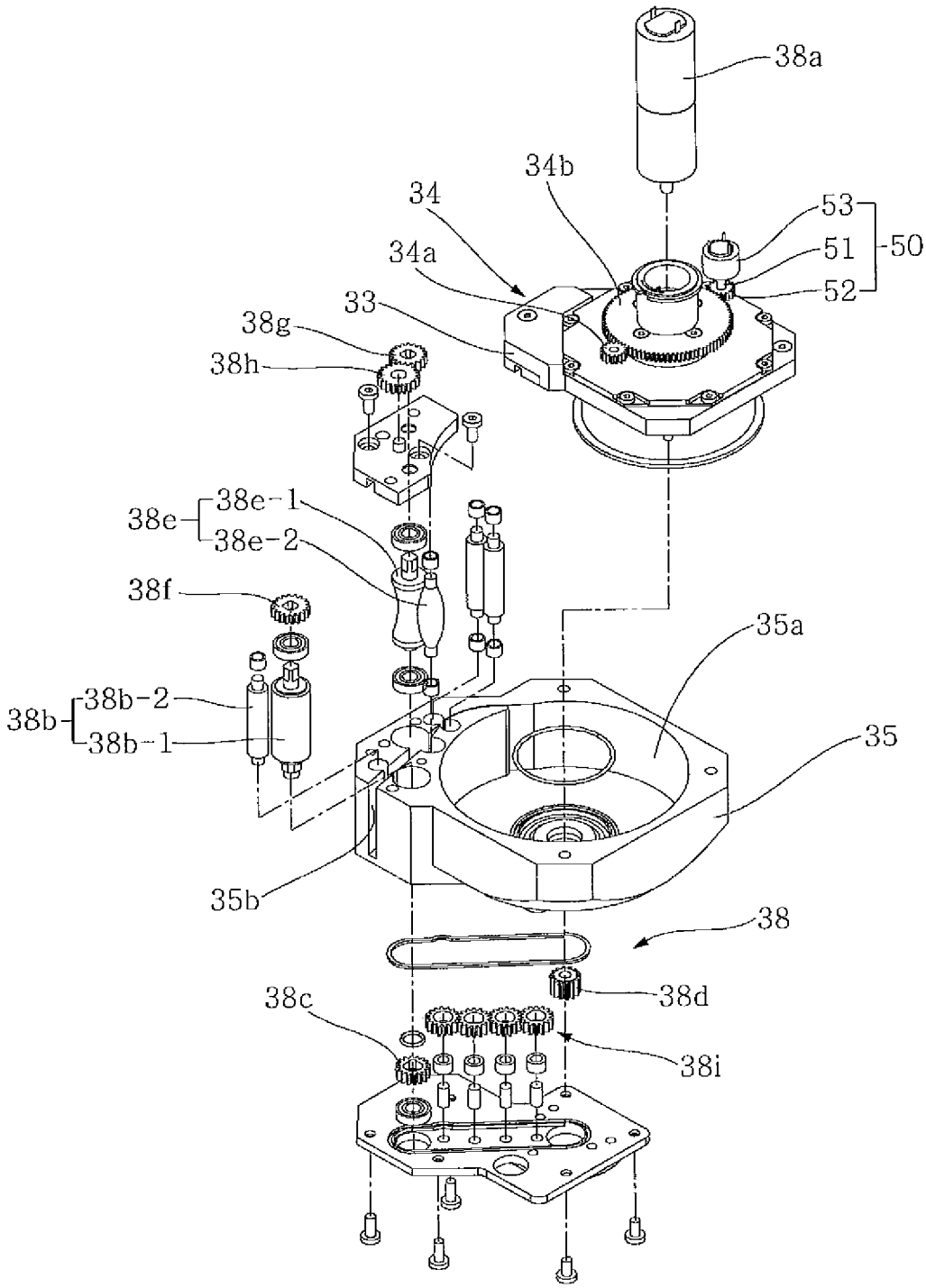
FIG. 14 is an exploded perspective view illustrating a winding means of an apparatus for visually inspecting and removing a foreign substance from a gap of a heat tube bundle in an upper part of a tube sheet of a second side of a steam generator according to the present invention.

As shown in FIG. 14, the winding means 38 includes a fourth motor 38*a* that is provided in the rotation plate 33; a pair of rolls 38*b* consisting of one side roll (38*b*-1) that is provided in one side of the groove 35*b* of the case 35 and that is provided in one side of the groove 35*b* to grasp a part of the probe 37 positioned at the groove 35*b* and the other side roll (38*b*-2) that is provided in the other side of the groove 35*b*; a fifteenth gear 38*c* that is provided in a rotation shaft of the one side roll (38*b*-1); a sixteenth gear 38*d* that is provided in a drive shaft of the fourth motor 38*a*; a pair of auxiliary rolls 38*e* consisting of one side auxiliary roll (38*e*-1) that is provided in one side of the roll 38*b*, and that grasps a part of the belt 36 received in the groove 35*b* of the case 35, and that is provided in one side of the groove 35*b* of the case 35 and the other side auxiliary roll (38*e*-2) that is provided in the other side of the groove 35*b*; a seventeenth gear 38*f* that is provided in the rotation shaft of the one side roll (38*b*-1), an eighteenth gear 38*g* that is provided in a rotation shaft of the one side auxiliary roll (38*e*-1); a nineteenth gear 38*h* that is provided to engage with the seventeenth gear 38*f* and the eighteenth gear 38*g*; and a plurality of idle gears 38*i* that are positioned between the fifteenth gear 38*c* and the sixteen gear 38*d* and that transfer a drive force of the fourth motor 38*a* to the one side roll (38*b*-1) to wind or unwind the belt 36.

When the one side roll (38*b*-1) rotates, the one side auxiliary roll (38*e*-1) is also rotated by the seventeenth gear 38*f* that is provided in the rotation shaft of the one side roll (38*b*-1), the eighteenth gear 38*g* that is provided in the rotation shaft of the one side auxiliary roll (38*e*-1), and the nineteenth gear 38*h* that is provided to engage with the seventeenth gear 38*f* and the eighteenth gear 38*g*, whereby the belt 36 positioned between the one side auxiliary roll (38*e*-1)and the other side auxiliary roll (38*e*-2) is unwound.

As shown in FIG. 13, a rotation angle measurement device 50 for measuring a rotation angle of the rotation plate 33 may be provided in the visual inspector 30, and the rotation angle measurement device 50 includes a rotation shaft 51, a fifteenth gear 52 that is engaged with a fourteenth gear 35*b* fixed to the rotation plate 33, and an encoder 53 that is fixed to the box 32.

Figure 15:
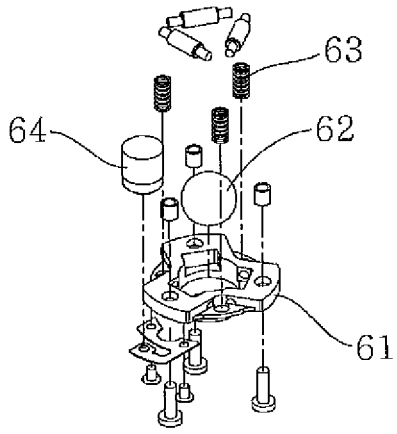
FIG. 15 is a view illustrating a falling control means of an apparatus for visually inspecting and removing a foreign substance from a gap of a heat tube bundle in an upper part of a tube sheet of a second side of a steam generator according to the present invention.

As shown in FIG. 13 or 15, a falling control means for measuring a falling position may be further provided in the visual inspector 30 that moves upward and downward by the lift 20, and the falling control means 60 includes a plate 61 that is slidably provided in a lower part of the case 35, a ball 62 that is rotatably provided in the plate 61 and that contacts with an upper surface of a tube sheet of a second side of the steam generator G when the visual inspector 30 falls, and a plurality of third springs 63 that are provided between the case 35 and the plate 61 to sustainably push the plate 61, and a sensor 64 that is provided in one side of the plate 61 and that measures that the plate 61 slides by the ball 62 contacting with the tube sheet of the second side of the steam generator G, and that sends a signal to the controller 2 and the remote controller 3.

The controller 2 or the remote controller 3 receives and recognizes the signal of the sensor 64 and then stops the driving of the second motor 23, thereby stopping falling of the lift 20.

Further, as shown in FIG. 13, it is preferable that a displacement sensor 65 for checking whether the transfer unit 10 transfers in the same height on an inner wall surface of the steam generator G is further provided in the visual inspector 30, and the displacement sensor 65 is provided in one side of the box 32, is connected to the controller 2 by a wire, and has a measurement rod 65*a* for measuring the change of a height thereof when the transfer unit 10 moves as a free end thereof contacts with the tube sheet of the second side of the steam generator G.

Figure 16:
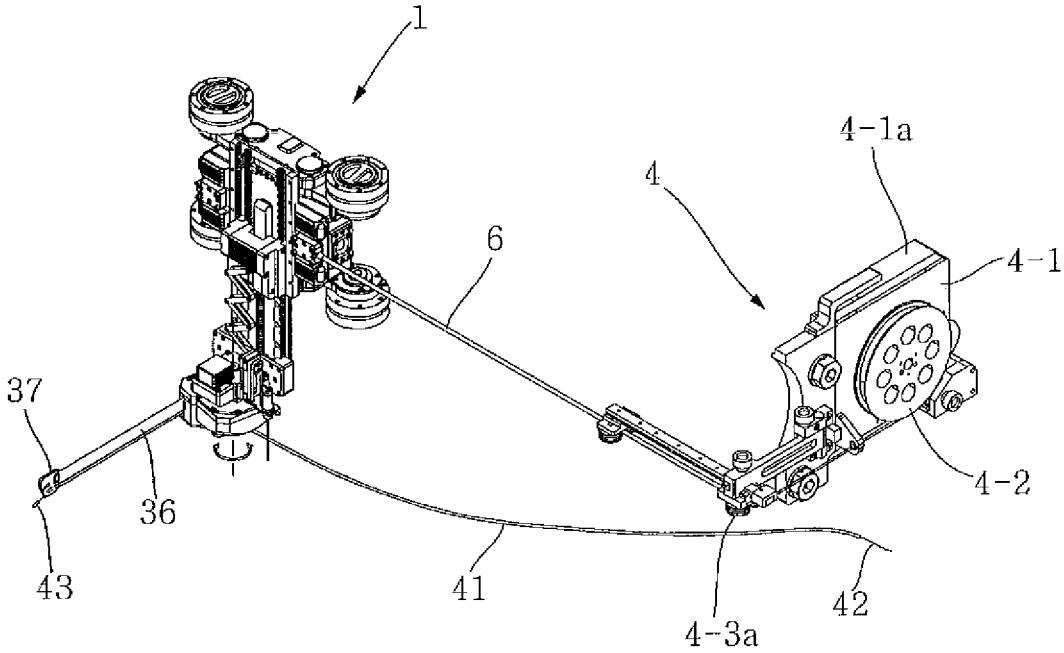
FIG. 16 is a view illustrating a foreign substance remover of an apparatus for visually inspecting and removing a foreign substance from a gap of a heat tube bundle in an upper part of a tube sheet of a second side of a steam generator according to the present invention.
Figure 17:
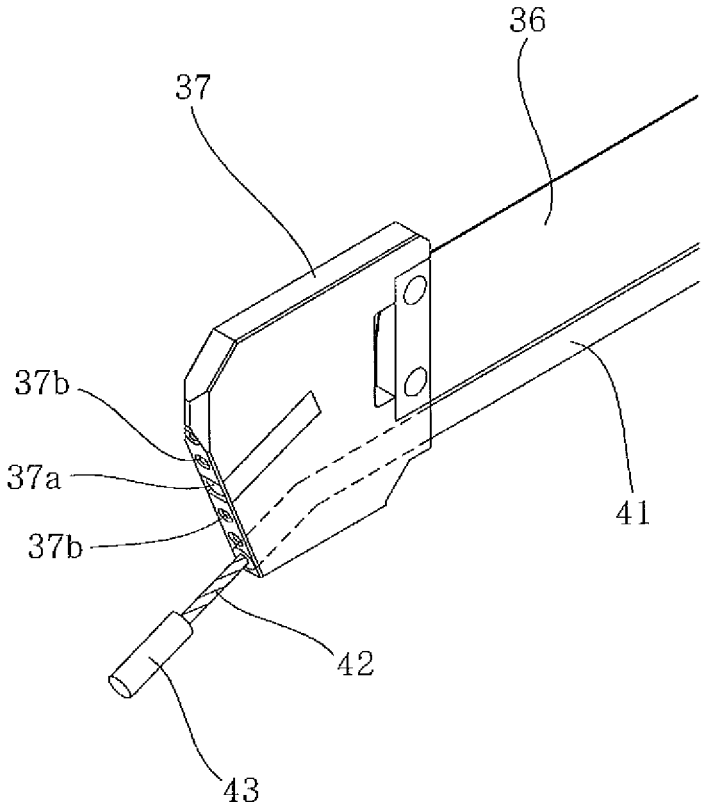
FIG. 17 is an enlarged view of a major part of FIG. 16.

As shown in FIGS. 16 and 17, the foreign substance removal device includes a guide tube 41 that is provided in the probe 37 to expose one end thereof and whose the other end has a length to be positioned at the outside of the steam generator G, a wire 42 that is inserted into and penetrates through the guide tube 41, and a foreign substance removal member 43 that is provided in an end part of the wire 42.

The foreign substance removal member 43 includes any one selected among a magnet and a hook.

As shown in FIG. 10, a cable tray 66 may be provided in the lift 20, and as a plurality of links are rotatably provided, when the slide block 27 moves upward and downward, the cable tray 66 is folded and extended.

Figure 18:
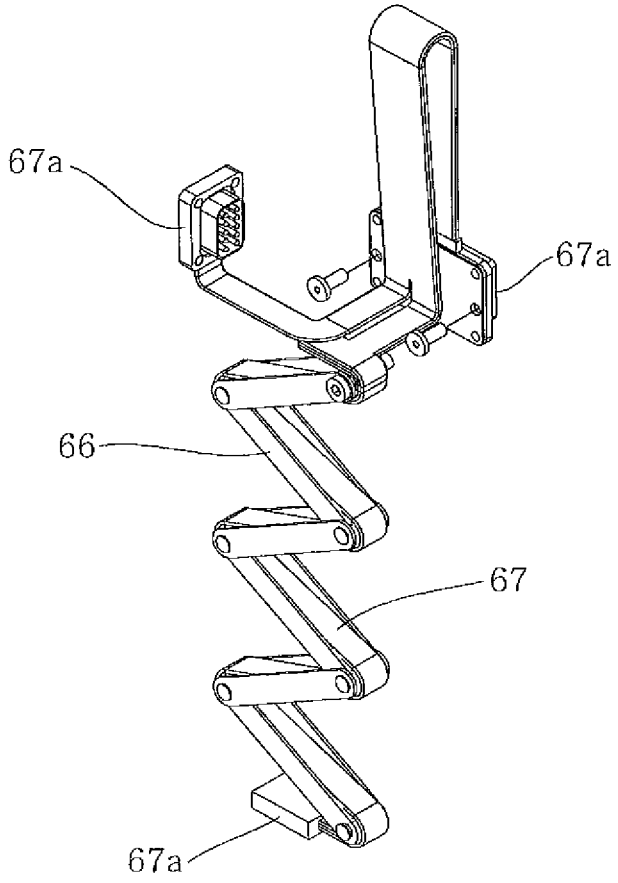
FIG. 18 is a view illustrating a cable tray of FIG. 10 and a plot cable provided in the cable tray.

As shown in FIG. 18, a plot cable 67 is provided in the cable tray 66, and has a connector 67*a* at both ends thereof so that one end thereof is connected to the controller 2 and the other end thereof is connected to the lift 20 and the visual inspector 30 through a wire.

Here, a wire for connecting the controller 2, the lift 20, and the visual inspector 30 is not shown.

As shown in FIG. 1 or 16, the encoder mounting fixture 4 is fixed to one side of the handhole H of the steam generator G and includes a fixing plate (4-1) having a terminal (4-1*a*) connected to the first cable 5, a pulley (4-2) for receiving and supplying a second cable 6 connected to the robot 1 rotatably provided at one surface of the fixing plate (4-1), and bar having a guide roll (4-3*a*) that is slideably provided in one side of the fixing plate (4-1), whose part is inserted into the handhole H of the steam generator G, and that guides the second cable 6 to both sides of a bottom surface.

The controller 2 is connected through the robot 1, the first cable 5, and the second cable 6, is provided in one side of the steam generator G, and controls an operation of the robot 1 by a manipulation of an operator.

The remote controller 3 is provided at the outside and is connected to the controller 2 through a wire to control an operation of the robot 1 through the controller 2.

An installation state and an operating state of the apparatus for visually inspecting and removing a foreign substance from a gap of the heat tube bundle in the upper part of the tube sheet of the second side of the steam generator according to the present invention having such a configuration are described as follows.

First, the encoder mounting fixture 4 is fixed to one side of the handhole H of the steam generator G, the controller 2 and the remote controller 3 are positioned at one side and the outside of the steam generator G, respectively, the controller 2 and the remote controller 3 are connected through a wire, and the controller 2 and the encoder mounting fixture 4 are connected through the first cable 5.

After the robot 1 and the encoder mounting fixture 4 are connected using the second cable 6, the robot 1 is attached to an inner wall surface of the steam generator G through the handhole H.

Figure 19:
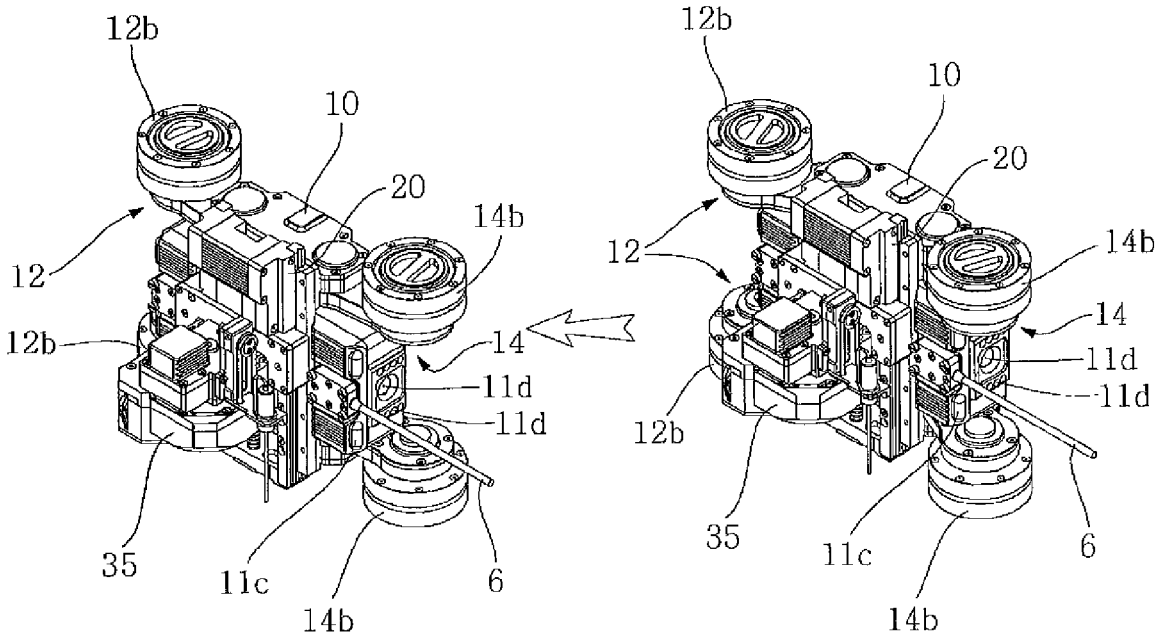
FIG. 19 is a view illustrating a rotating state of a front wheel arm and a rear wheel arm of a transfer unit of an apparatus for visually inspecting and removing a foreign substance from a gap of a heat tube bundle in an upper part of a tube sheet of a second side of a steam generator according to the present invention.
Figure 20:
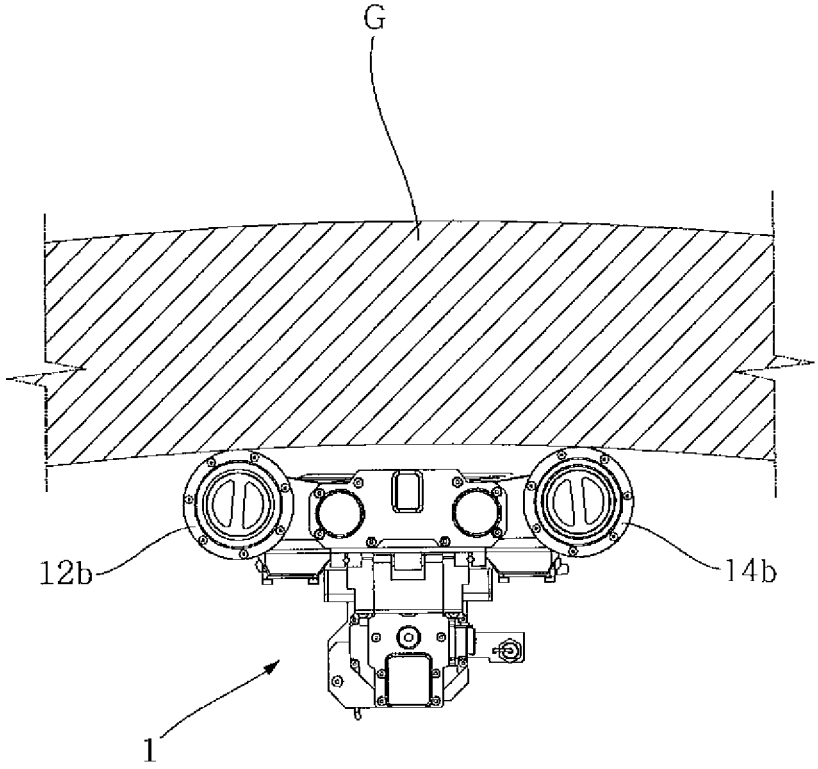
FIG. 20 is a view illustrating a state in which an apparatus for visually inspecting and removing a foreign substance from a gap of a heat tube bundle in an upper part of a tube sheet of a second side of a steam generator according to the present invention is attached to an inner wall surface of the steam generator.

Thereafter, if an operator grasps the main body 11 of the transfer unit 10 of the robot 1 and pulls the main body 11 to the inside thereof, the front wheel arm 12 and the rear wheel arm 14 are rotated by the first magnetic wheel 12*b* and the second magnetic wheel 14*b* attached to the inner wall surface of the steam generator G, as shown in FIG. 19, and the robot 1 is provided in the inner wall surface of the steam generator G, as shown in FIG. 20.

In this case, the equalizer 17 that is engaged with threads 12*a* and 14*a* formed at one end of the front wheel arm 12 and the rear wheel arm 14 and that is slidably provided in the main body 11 is moved to one side thereof, and if the equalizer 17 moves by a predetermined distance, as the second spring 18*h* pushes the plate 18*g* having the fastening pin (18*g*-1) provided to contact with one surface of the equalizer 17, one end of the fastening pin (18*g*-1) is protruded to the outside of the main body 11 to fix the equalizer 17.

Figure 21:
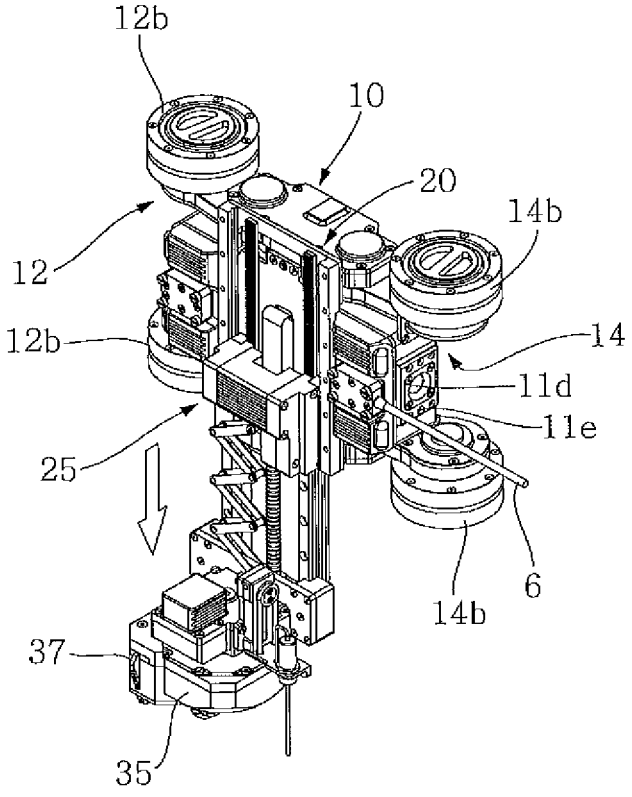
FIG. 21 is a view illustrating a driving state of a lift of an apparatus for visually inspecting and removing a foreign substance from a gap of a heat tube bundle in an upper part of a tube sheet of a second side of a steam generator according to the present invention.

In this state, when the second motor 23 of the lift 20 is rotated by manipulating the controller 2 or the remote controller 3, power of the second motor 23 drives a gear assembly 24 and thus the gear box 25 and the slide block 27 fall, as shown in FIG. 21.

Specifically, when power of the second motor 23 is transferred to a pinion gear 24*e* through a ninth gear 24*a*, a tenth gear 24*b*, an eleventh gear 24*c*, and a twelfth gear 24*d*, the pinion gear 24*e* rotates, the gear box 25 falls along a first guide rail 21 by a rack gear 24*f* that is engaged with the pinion gear 24*e* and that is fixed to the main body 11 of the transfer unit 10.

That is, the slide bar 22 fixed to one side of the gear box 25 moves along the first guide rail 21.

In this case, if the screw 28 is rotated by the driving bevel gear 24*g* that is provided in the shaft rod of the twelfth gear 24*d* and the driven bevel gear 24*h* that is engaged with the driving bevel gear 24*g* and that is fixed to an upper end of the screw 28, the slide block 27 whose thread is engaged with the screw 28 and that is slidably provided in the second guide rail 26 provided in one side of the slide bar 22 falls.

As the slide block 27 falls, the visual inspector 30 provided in the slide block 27 also falls, and when the visual inspector 30 falls by a predetermined length, driving of the second motor 23 is stopped by a failing control means 60 provided in a lower part of the visual inspector 30.

Figure 22:
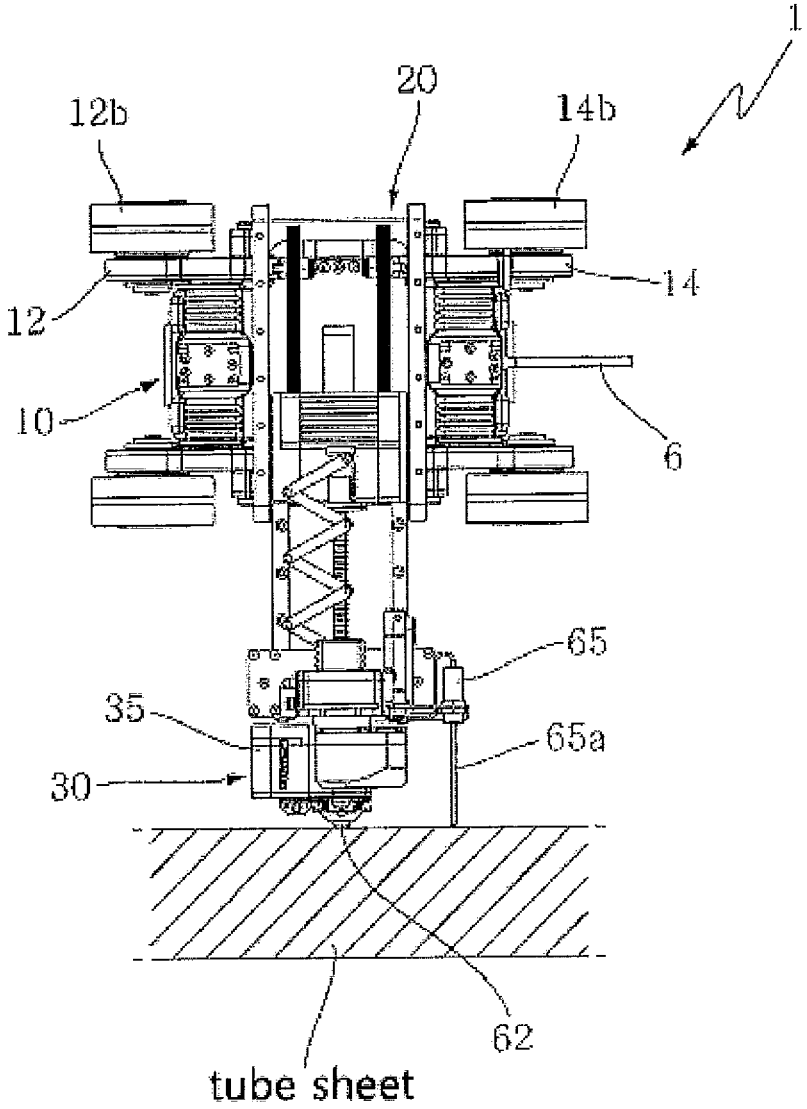
FIG. 22 is a view illustrating a state in which a falling control means and a displacement sensor of an apparatus for visually inspecting and removing a foreign substance from a gap of a heat tube bundle in an upper part of a tube sheet of a second side of a steam generator according to the present invention contact with the tube sheet of the steam generator.

In other words, as shown in FIG. 22, if the ball 62 of the falling control means 60 contacts with the tube sheet of the second side of the steam generator G, a plate 61 in which the ball 62 is provided moves, and after a sensor 64 provided in one side of the plate 61 recognizes movement of the plate 61, the sensor 64 transmits a signal to the controller 2 and the remote controller 3.

Accordingly, the controller 2 or the remote controller 3 stops the driving of the second motor 23 of the lift 20 for falling the visual inspector 30.

Thereafter, the controller 2 or the remote controller 3 drives the third motor 31 provided in the box 32.

Accordingly, the rotation plate 33 is rotated by a thirteenth gear 34*a* that is provided in a drive shaft of the third motor 31 and the fourteenth gear 34*b* that is engaged with the thirteenth gear 34*a* and that is fixed to an upper surface of the rotation plate 33.

Figure 23A:
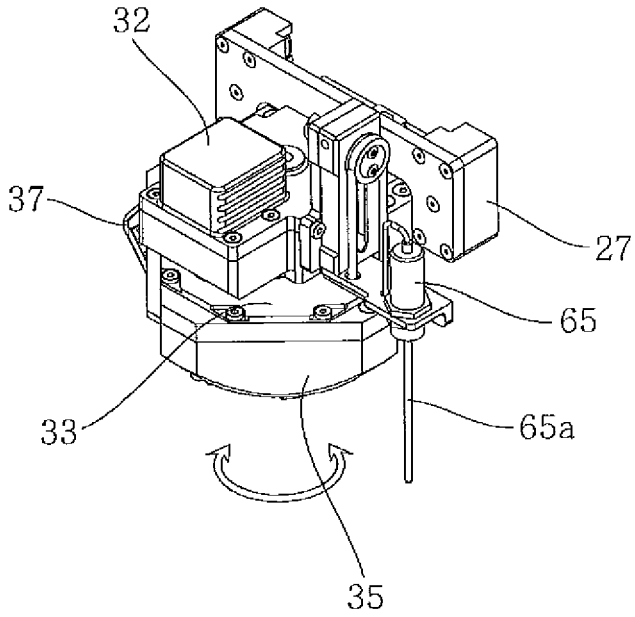
FIGS. 23*a* to 23*c* are views illustrating a rotating state of a rotation plate of a visual inspector of an apparatus for visually inspecting and removing a foreign substance from a gap of a heat tube bundle in an upper part of a tube sheet of a second side of a steam generator according to the present invention.
Figure 23B:
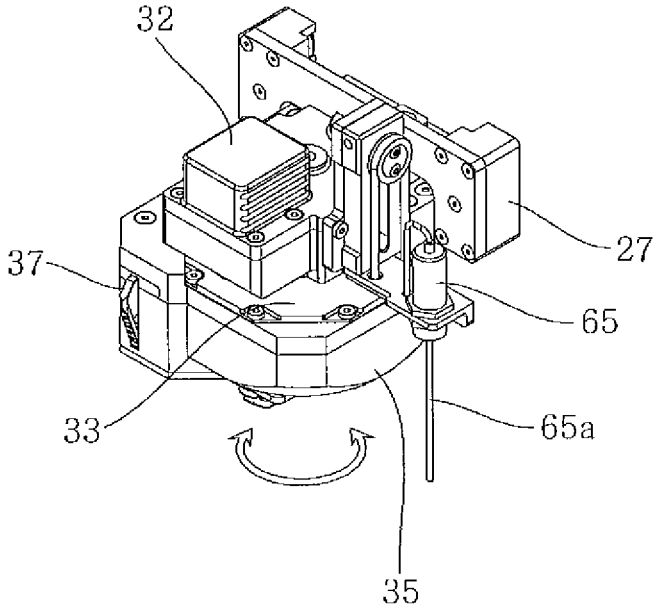
Figure 23C:
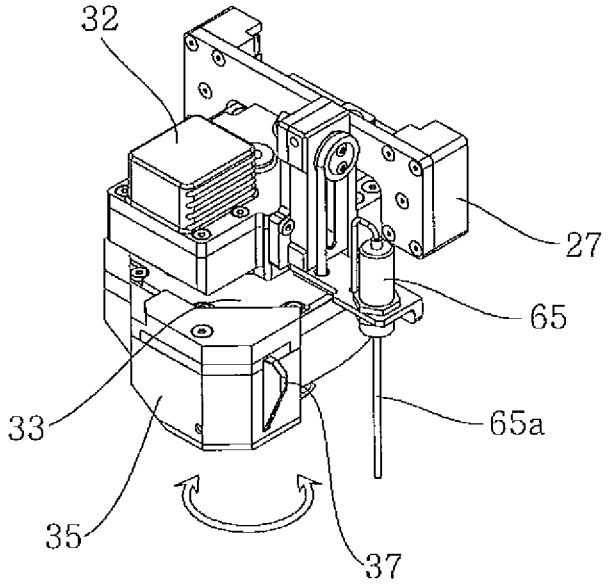

That is, as shown in FIGS. 23*a* to 23*c*, the rotation plate 33 is rotated by an angle that the probe 37 of the visual inspector 30 can be inserted into a gap of the heat tube bundle.

Thereafter, the fourth motor 38*a* of the winding means 38 rotates.

Figure 24:
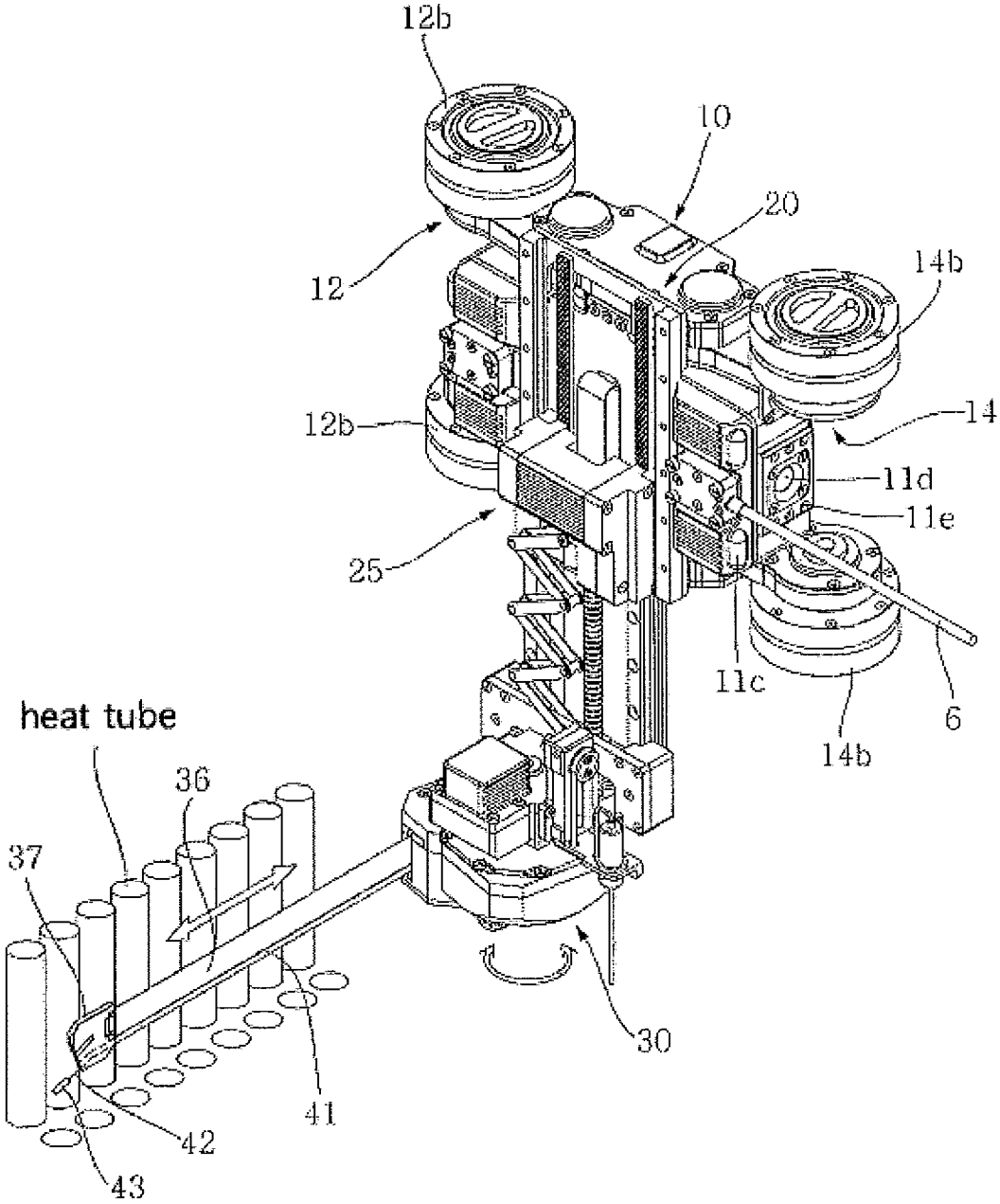
FIG. 24 is a view illustrating a state in which a probe of an apparatus for visually inspecting and removing a foreign substance from a gap of a heat tube bundle in an upper part of a tube sheet of a second side of a steam generator according to the present invention is inserted into the gap of the heat tube bundle.

Accordingly, as shown in FIG. 24, as power of the fourth motor 38*a* is transferred to the one side roll (38*b*-1) by an idle gear 38*i* provided between a sixteenth gear 38*d* provided in a drive shaft of the fourth motor 38*a* and a fifteenth gear 38*c* provided in a lower rotation shaft of the one side roll (38*b*-1), the one side roll (38*b*-1) rotates, whereby the probe 37 that is grasped between the one side roll (38*b*-1) and the other side roll (38*b*-2) and that is received in a groove 35*b* of the case 35 is moved.

In this case, when the roll rotates, the auxiliary roll 38*e* provided at one side thereof also rotates. Specifically, when the one side roll (38*b*-1) is rotated by the seventeenth gear 38*f* provided in the rotation shaft of the one side roll (38*b*-1), the eighteenth gear 38*g* provided in the rotation shaft of one side auxiliary roll (38*e*-1), and the nineteenth gear 38*h* provided to engage with the seventeenth gear 38*f* and the eighteenth gear 38*g*, the one side auxiliary roll (38*e*-1) also rotates, whereby the belt 36 grasped between the one side auxiliary roll (38*e*-1) and the other side auxiliary roll (38*e*-2) is unwound.

If the belt 36 is unwound by the winding means 38, the probe 37 provided at one end of the belt 36 is inserted into a gap of the heat tube bundle provided in the tube sheet of the second side of the steam generator G, as shown in FIGS. 17 to 24. In this case, the second light-emitting diode 37*b* provided in the probe 37 lights a portion to inspect and sludge or a foreign substance of the portion is visually inspected through the second camera 37*a*.

As shown in FIG. 17, if sludge or a foreign substance is found through the second camera 37*a*, by inserting the foreign substance removal member 43 having a wire 42 at one end thereof into a guide tube 41 whose one end is exposed in the probe 37 and whose the other end has a length to be positioned at the outside of the steam generator G, the sludge or the foreign substance is removed using the foreign substance removal member 43.

After a gap of one heat tube is inspected in this way, the unwound belt 36 is wound to its original state by reversely rotating the fourth motor 38*a* of the winding means 38.

Thereafter, if the third motor 31 is driven so that the probe 37 may insert into a gap of another heat tube, by the thirteenth gear 34*a* provided in a drive shaft of the third motor 31 and the fourteenth gear 34*b* that is engaged with the thirteenth gear 34*a* and that is fixed to an upper surface of the rotation plate 33, the rotation plate 33 rotates, and then by inserting the probe 37 into a gap of another heat tube using the winding means 38, sludge or foreign substance is inspected.

Figure 25:
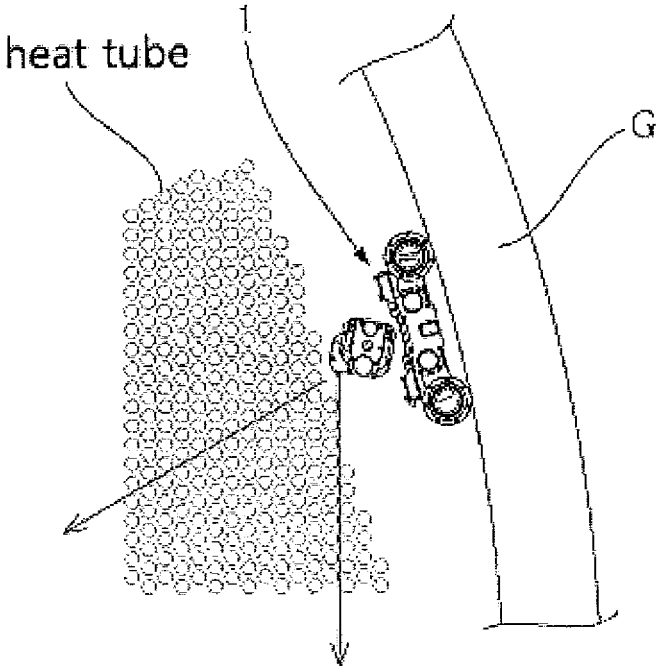
FIG. 25 is a view illustrating a state in which an apparatus for visually inspecting and removing a foreign substance from a gap of a heat tube bundle in an upper part of a tube sheet of a second side of a steam generator according to the present invention inspects a gap of the heat tube.

That is, as shown in FIG. 25, the rotation plate 33 is rotated by driving the third motor 31, and a rotation angle of the rotation plate 33 is several angles for inserting the probe 37 into a gap of the heat tube.

The fifteenth gear 52 engaged with the fourteenth gear 34*b* fixed to the rotation plate 33 is provided in the rotation shaft 51, and the rotation angle measurement device 50 including the encoder 53 fixed to the box 32 measures a rotation angle of the rotation plate 33 and thus an operator can see a rotation angle of the rotation plate 33.

Thereafter, if all gaps of the heat tube bundle that can be inspected at one spot are inspected, the first motor 11*b* of the transfer unit 10 rotates.

If the first motor 11*b* is driven, the first gear 13*a* provided in a drive shaft of the first motor 11*b* rotates, the third gear 13*c* provided to engage with the first gear 13*a* rotates, and as the second gear 13*b* that is engaged with the third gear 13*c* and that is provided in the rotation shaft of the first magnetic wheel 12*b* rotates, the first magnetic wheel 12*b* rotates.

In this case, the seventh gear 16*a* provided at an upper end of the drive shaft of the first motor 11*b* also rotates, and an eighth gear 16*b* that is connected to the seventh gear 16*a* using the chain 16*c* and that is provided in a shaft of the fourth gear 15*a* rotatably provided in a third reception unit 14*c* of the rear wheel arm 14 also rotates.

The fourth gear 15*a* is also rotated by rotation of the eighth gear 16*b*, the sixth gear 15*c* engaged with the fourth gear 15*a* also rotates, and as the fifth gear 15*b* that is engaged with the sixth gear 15*c* and that is provided in the rotation shaft of the second magnetic wheel 14*b* rotates, the second magnetic wheel 14*b* rotates.

Figure 26:
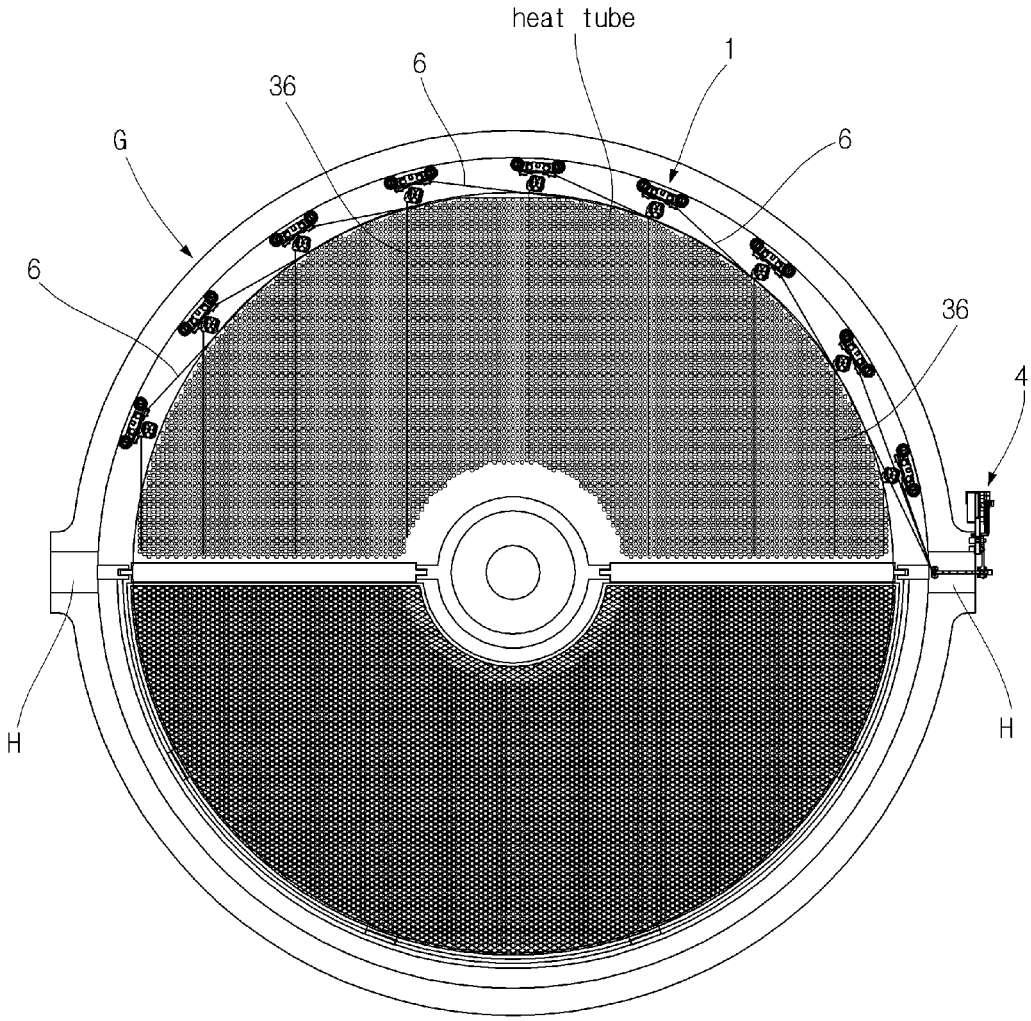
FIG. 26 is a view illustrating a state in which a robot of an apparatus for visually inspecting and removing a foreign substance from a gap of a heat tube bundle in an upper part of a tube sheet of a second side of a steam generator according to the present invention moves on an inner wall surface of the steam generator.

As described above, as the first motor 11*b* rotates, the first magnetic wheel 12*b* and the second magnetic wheel 14*b* rotate and the transfer unit 10 thus moves by a predetermined distance, as shown in FIG. 26, and in this case, an operator stops driving of the first motor 11*b* through the controller 2 or the remote controller 3.

When the transfer unit 10 moves, the displacement sensor 65 measures whether the transfer unit 10 moves in the same height and if the height thereof changes, the controller 2 recognizes the change and controls the driving of one of a pair of first motors 11*b* to allow the transfer unit 10 to be transferred in the same height.

The remote controller 3 is manipulated to control the driving of one of a pair of first motors 11*b*, whereby the transfer unit 10 is transferred in the same height.

As the transfer unit 10 moves, the pulley (4-2) provided in the encoder mounting fixture 4 unwinds the second cable 6 connected to the robot 1 while rotating.

Thereafter, by repeatedly performing the above-described method, the gap of the heat tube bundle is inspected.

When the inspection is completed, the robot 1 is separated from the inner wall surface of the steam generator G.

Thereafter, the handle 18*i* of the fixing and release means 18 formed to be exposed in the main body 11 of the transfer unit 10 is grasped and pulled.

Accordingly, the fourth rod 18*e* connected to the handle 18*i* moves along the hole (18*f*-1) of the guide block 18*f* and thus the second rod 18*c* rotatably connected to the fourth rod 18*e* also moves, and thus the disk 18*a* is rotated.

In this case, as the disk 18*a* rotates, the first rod 18*b* whose one end is rotatably connected to the disk 18*a* is also pulled to the inside of the disk 18*a*, whereby the third rod 18*d* whose one end is rotatably connected to the first rod 18*b* also moves along the hole (18*f*-1) of the guide block 18*f*.

Accordingly, as the plate 18*g* that is fixed to a free end of the third rod 18*d* and in which the fastening pin (18*g*-1) is formed moves toward the disk, the fastening pin (18*g*-1) locked the equalizer 17 is moved to the inside of the main body 11 to release locking of the equalizer 17.

As the fastening pin (18*g*-1) releases locking of the equalizer 17, the equalizer 17 returns to its original position by a restoring force of the first spring 19 positioned between the main body 11 and the equalizer 17, and in this case, the front wheel arm 12 and the rear wheel arm 14 engaged with the equalizer 17 also return to their original positions while rotating.

Thereafter, if an operator releases the pulled handle 18*i*, the second spring 18*h* provided between the plate 18*g* and the guide block 18*f* sustainably pushes the plate 18*g*, and the fastening pin (18*g*-1) formed in the plate 18*g* is in a state that sustainably pushes one surface of the equalizer 17, i.e. a fixing preparation state of the equalizer 17.

After the second cable 6 connected to the robot 1 is separated from the robot 1, the second cable 6 is wound to the pulley (4-2) of the encoder mounting fixture 4, and the encoder mounting fixture 4 is separated from the handhole H of the steam generator G.

Thereafter, the first cable 5 connected to the encoder mounting fixture 4 is separated from the encoder mounting fixture 4, and the robot 1, the encoder mounting fixture 4, the controller 2, and the remote controller 3 are stored at a storage place.

As described above, according to the present invention, a robot is provided in an inner wall of the steam generator through the handhole of the steam generator and visually inspects a gap of a heat tube bundle of a second side of the steam generator while moving on the inner wall, and when a foreign substance is found, the robot can remove the foreign substance.

Further, the robot is controlled through a controller provided on the spot, thereby providing user convenience.

Further, by controlling the robot through a remote controller provided at the outside, an amount of radiation to be radiated to an operator can be remarkably reduced.

The embodiment of the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for visually inspecting and removing a foreign substance from a gap of a heat tube bundle in an upper part of a tube sheet of a second side of a steam generator, comprising:

a robot comprising a transfer unit that moves on a wall surface within a ring of the steam generator, a lift that is provided in the transfer unit to vertically move upward and downward, a visual inspector that is rotatably provided in the lift, and that moves upward and downward by driving the lift, and that monitors sludge or a foreign substance injected into a gap of the heat tube, and a foreign substance remover that is provided at one side of the visual inspector and that removes the sludge or the foreign substance existing in the gap of the heat tube;

a controller that is provided at one side of the steam generator for controlling the robot on the spot;

a remote controller that is provided at the outside, and that is connected to the controller for controlling the robot; and an encoder mounting fixture that is fixed to one side of a handhole of the steam generator, and that is connected to the controller through a first cable, and that receives and supplies a second cable connected to the robot, wherein the transfer unit comprises:

a main body that has a pair of first motors therein;

a front wheel arm that is rotatably provided in both sides of one side of the main body, and that has a first thread at one end surface thereof, and that has a first magnetic wheel in one surface of the other side thereof;

a first gear group that is provided within the front wheel arm and that drives the first magnetic wheel provided in the front wheel arm by transferring power of the first motor;

a rear wheel arm that is symmetrical to the front wheel arm and rotatably provided in both surfaces of the other side of the main body, and that has a second thread in one end surface thereof, and that has a second magnetic wheel in one surface of the other side thereof;

a second gear group that is provided within the rear wheel arm and that drives the second magnetic wheel provided in the rear wheel arm by transferring power of the first motor;

a power transmission means that transfers power of the first motor to the second gear group;

an equalizer that is provided in the main body to engage with the first thread of the front wheel arm and the second thread of the rear wheel arm and that is slidably provided when the first wheel arm and the rear wheel arm are rotated by the first and second magnetic wheels attached to the inner wall surface of the steam generator when an operator pulls the main body;

a fixing and release means that is provided in the main body and that fixes and releases the moved equalizer; and a first spring that is provided between the main body and the equalizer and that returns the rotated front wheel arm and rear wheel arm to their original positions by pushing the equalizer in which fixing is released by the fixing and release means.

2. The apparatus of claim 1, wherein the first gear group comprises:

a first gear that is positioned within the front wheel arm and that is provided in a drive shaft of the first motor;

a second gear that is provided in a rotation shaft of the first magnetic wheel of the front wheel arm; and a third gear that is provided to engage with the first gear and the second gear.

3. The apparatus of claim 1, wherein the second gear group comprises:

a fourth gear that is positioned within the rear wheel arm and that has a shaft;

a fifth gear that is provided in a rotation shaft of the second magnetic wheel of the rear wheel arm; and a sixth gear that is provided to engage with the fourth gear and the fifth gear.

4. The apparatus of claim 1, wherein the power transmission means comprises:

a seventh gear that is provided in a drive shaft of the first motor;

an eighth gear that is provided in a shaft of the fourth gear; and a chain that is provided in the seventh gear and the eighth gear.

5. The apparatus of claim 1, wherein the fixing and release means comprises:

a disk that is rotatably provided within the main body;

a pair of first rods that is rotatably provided at both sides of the disk;

a pair of second rods that is rotatably provided at a position forming an acute angle with the first rods;

a third rod that is rotatably provided in the first rod;

a fourth rod that is rotatably provided in the second rod;

a guide block that is fixed within the main body and that has a hole for receiving a part of the third rod and the fourth rod;

a plate that is fixed to a free end of the third rod and in which a fastening pin for fixing the equalizer is provided in one surface thereof to be exposed to the outside of the main body;

a second spring that is provided between the guide block and the plate to sustainably push the plate; and a handle that is provided at a free end of the fourth rod and that is exposed to the outside of the main body.

6. The apparatus of claim 1, wherein at least one light is provided in both surfaces of the main body.

7. The apparatus of claim 1, wherein a first camera is further provided in both surfaces of the main body.

8. The apparatus of claim 7, wherein at least one first light-emitting diode is provided in one side or both sides of the first camera.

9. The apparatus of claim 1, wherein the lift comprises:

a first guide rail that is vertically provided in parallel to the main body;

a slide bar that is movably provided in the first guide rail;

a gear box that is provided in the slide bar and that has a second motor and a gear assembly therein;

a second guide rail that is provided in one surface of the slide bar;

a slide block that is provided in the second guide rail; and a screw whose thread is engaged with the slide block and whose upper end is connected to the gear assembly to move the slide block when the gear assembly is driven.

10. The apparatus of claim 9, wherein the gear assembly comprises:

a ninth gear that is provided in a drive shaft of the second motor;

a tenth gear that is provided to engage with the ninth gear;

an eleventh gear that is provided to engage with the tenth gear;

a twelfth gear that is provided to engage with the eleventh gear;

a pinion gear that is provided at both ends of a shaft rod of the twelfth gear;

a rack gear that is provided in the main body to be parallel to the first guide rail and that is engaged with the pinion gear to move the gear box upward and downward when the pinion gear is driven;

a driving bevel gear that is provided at one point of the shaft rod of the twelfth gear; and a driven bevel gear that is provided at an upper end of the screw and that is engaged with the driving bevel gear.

11. The apparatus of claim 1, wherein a rotation angle measurement device for measuring a rotation angle of a rotation plate is provided in the visual inspector.

12. The apparatus of claim 11, wherein the rotation angle measurement device comprises an encoder in which a fifteenth gear engaged with a fourteenth gear is provided in a rotation axis and that is fixed to a box.

13. The apparatus of claim 1, wherein a falling control means for measuring a falling position is provided in the visual inspector.

14. The apparatus of claim 13, wherein the falling control means comprises:

a plate that is slidably provided in a lower part of a case;

a ball that is rotatably provided in the plate and that contacts with the tube plate of the steam generator;

a plurality of third springs that are provided between the case and the plate to sustainably push the plate; and a sensor that is provided in one side of the plate and that measures that the plate slides by the ball contacting with the tube plate of the steam generator, and that sends a signal to the controller and the remote controller.

15. The apparatus of claim 1, wherein the foreign substance remover comprises:

a guide tube that is provided in a probe to expose one end thereof and whose other end has a length to be positioned at the outside of the steam generator;

a wire that is inserted into the guide tube and that penetrates through the guide tube; and a foreign substance removal member that is provided at an end part of the wire.

16. The apparatus of claim 15, wherein the foreign substance removal member comprises any one selected from a magnet and a hook.

17. The apparatus of claim 1 or 9, wherein a cable tray is provided in the lift.

18. The apparatus of claim 17, wherein the cable tray which can be folded as a plurality of links are rotatably provided.

19. The apparatus of claim 17, wherein a plot cable is provided in the cable tray.

20. The apparatus of claim 19, wherein the plot cable is provided in the cable tray and has a connector at both ends thereof so that one end thereof is connected to the controller and the other end thereof is connected to the lift and the visual inspector.

21. The apparatus of claim 1, wherein the encoder mounting fixture comprises:

a fixing plate that is fixed to the one side of the handhole of the steam generator and that has a terminal connected to the first cable;

a pulley that receives and supplies the second cable connected to the robot rotatably provided in one surface of the fixing plate; and a bar that is slidably provided in one side of the fixing plate, and whose part is inserted into the handhole of the steam generator, and that has a guide roll for guiding the second cable in both sides of a bottom surface thereof.

22. An apparatus for visually inspecting and removing a foreign substance from a gap of a heat tube bundle in an upper part of a tube sheet of a second side of a steam generator, comprising:

a robot comprising a transfer unit that moves on a wall surface within a ring of the steam generator, a lift that is provided in the transfer unit to vertically move upward and downward, a visual inspector that is rotatably provided in the lift, and that moves upward and downward by driving the lift, and that monitors sludge or a foreign substance injected into a gap of the heat tube, and a foreign substance remover that is provided at one side of the visual inspector and that removes the sludge or the foreign substance existing in the gap of the heat tube;

a controller that is provided at one side of the steam generator for controlling the robot on the spot;

a remote controller that is provided at the outside, and that is connected to the controller for controlling the robot; and an encoder mounting fixture that is fixed to one side of a handhole of the steam generator, and that is connected to the controller through a first cable, and that receives and supplies a second cable connected to the robot, wherein the vision inspector comprises:

a box that is provided in the lift and that has a third motor therein;

a rotation plate that is rotatably provided in a lower part of the box;

a rotation means that rotates the rotation plate;

a case that is provided in a lower part of the rotation plate, and that has a housing space therein, and that has a groove so that an external surface of one side thereof communicates with the housing space;

a belt whose one end is wound, and whose wound portion is positioned at the housing space of the case, and whose other end is received in the groove;

a probe that is provided at the other end of the belt and that has a second camera and a second light-emitting diode; and a winding means that unwinds and winds the belt.

23. The apparatus of claim 22, wherein the rotation means comprises:

a thirteenth gear that is provided in a driving shaft of the third motor; and a fourteenth gear that engages with the thirteenth gear and that is fixed to an upper surface of a rotation shaft.

24. The apparatus of claim 22, wherein the winding means comprises:

a fourth motor that is provided in the rotation plate;

a pair of rolls that is provided in one side of the groove of the case and that grasps a part of the probe positioned at the groove;

a fifteenth gear that is provided in the rotation plate of a one side roll;

a sixteenth gear that is provided in a driving shaft of the fourth motor;

a pair of auxiliary rolls that is provided in one side of the roll and that grasps a part of the belt received in the groove of the case;

a seventeenth gear that is provided in the rotation plate of a one side roll;

an eighteenth gear that is provided in the rotation plate of the one side auxiliary roll;

a nineteenth gear that is provided to engage with the seventeenth gear and the eighteenth gear; and a plurality of idle gears that are positioned between the fifteenth gear and the sixteenth gear and that wind or unwind the belt by transferring a driving force of the fourth motor to a one side roll.

25. The apparatus of claim 22, wherein a displacement sensor for checking whether the transfer unit transfers in the same height is provided in the visual inspector.

26. The apparatus of claim 25, wherein the displacement sensor is provided in one side of the box and has a measurement rod that is connected to the controller for measuring the change of a height of the transfer unit when the transfer unit, moving as a free end thereof, contacts with the tube sheet of the steam generator.

27. The apparatus of claim 22, wherein a rotation angle measurement device for measuring a rotation angle of the rotation plate is provided in the visual inspector.

28. The apparatus of claim 27, wherein the rotation angle measurement device comprises an encoder in which a fifteenth gear engaged with a fourteenth gear is provided in a rotation axis and that is fixed to a box.

29. The apparatus of claim 22, wherein a falling control means for measuring a falling position is provided in the visual inspector.

30. The apparatus of claim 29, wherein the falling control means comprises: a plate that is slidably provided in a lower part of the case; a ball that is rotatably provided in the plate and that contacts with the tube plate of the steam generator; a plurality of third springs that are provided between the case and the plate to sustainably push the plate; and a sensor that is provided in one side of the plate and that measures that the plate slides by the ball contacting with the tube plate of the steam generator, and that sends signal to the controller and the remote controller.

31. An apparatus for visually inspecting and removing a foreign substance from a gap of a heat tube bundle in an upper part of a tube sheet of a second side of a steam generator, comprising:

a robot comprising a transfer unit that moves on a wall surface within a ring of the steam generator, a lift that is provided in the transfer unit to vertically move upward and downward, a visual inspector that is rotatably provided in the lift, and that moves upward and downward by driving the lift, and that monitors sludge or a foreign substance injected into a gap of the heat tube, and a foreign substance remover that is provided at one side of the visual inspector and that removes the sludge or the foreign substance existing in the gap of the heat tube;

a controller that is provided at one side of the steam generator for controlling the robot on the spot;

a remote controller that is provided at the outside, and that is connected to the controller for controlling the robot; and an encoder mounting fixture that is fixed to one side of a handhole of the steam generator, and that is connected to the controller through a first cable, and that receives and supplies a second cable connected to the robot, wherein a displacement sensor for checking whether the transfer unit transfers in the same height is provided in the visual inspector.

32. The apparatus of claim 31, wherein the displacement sensor is provided in one side of a box and has a measurement rod that is connected to the controller for measuring the change of a height of the transfer unit when the transfer unit, moving as a free end thereof, contacts with the tube sheet of the steam generator.

* * * * *